US007798256B2

(12) United States Patent
Hoffmaster et al.

(10) Patent No.: US 7,798,256 B2
(45) Date of Patent: Sep. 21, 2010

(54) FIXED CUTTER DRILL BIT FOR ABRASIVE APPLICATIONS

(75) Inventors: Carl Hoffmaster, Houston, TX (US); Shelton W Alsup, Houston, TX (US); Michael G. Azar, The Woodlands, TX (US); Thomas W. Oldham, The Woodlands, TX (US); Stuart R. Oliver, Magnolia, TX (US); Sidney J. Isnor, Calgary (CA)

(73) Assignee: Smith International, Inc., Houston, TX (US)

( * ) Notice: Subject to any disclaimer, the term of this patent is extended or adjusted under 35 U.S.C. 154(b) by 950 days.

(21) Appl. No.: 11/367,097

(22) Filed: Mar. 3, 2006

(65) Prior Publication Data

US 2008/0230278 A9 Sep. 25, 2008

Related U.S. Application Data

(60) Provisional application No. 60/658,534, filed on Mar. 3, 2005.

(51) Int. Cl.
*E21B 10/42* (2006.01)

(52) U.S. Cl. ..... 175/408; 76/108.2

(58) Field of Classification Search ..... 175/39, 175/374, 393, 327, 408
See application file for complete search history.

(56) References Cited

U.S. PATENT DOCUMENTS 3,825,083 A * 7/1974 Flarity et al. ..... 175/394
5,074,367 A * 12/1991 Estes ..... 175/374
5,178,222 A * 1/1993 Jones et al. ..... 175/398
5,643,069 A * 7/1997 Christiansen et al. ..... 451/540
6,287,360 B1 * 9/2001 Kembaiyan et al. ..... 75/240
6,349,780 B1 2/2002 Beuershausen
6,575,256 B1 6/2003 Doster
2002/0166703 A1 * 11/2002 Presley et al. ..... 175/391
2003/0029644 A1 2/2003 Hoffmaster et al.
2003/0111273 A1 6/2003 Richert et al.

FOREIGN PATENT DOCUMENTS

EP 0522553 A1 1/1993
GB 2377241 A 1/2003

OTHER PUBLICATIONS

Carl Curtis et al; Heavy-Oil Reservoirs; periodical-Oilfield Review; Autumn 2002; pp. 30-51.

* cited by examiner

*Primary Examiner*—David J Bagnell
*Assistant Examiner*—Robert E Fuller

(57) ABSTRACT

The invention provides a fixed cutter drill bit for drilling through unconsolidated, highly abrasive formations. The bit includes a bit body having a cutting face and a side portion. The bit body comprising carbide matrix material. A plurality of blades azimuthally spaced about the cutting face and a plurality of cutters disposed along the blades. At least one gage pad is disposed along a side of the bit body and includes wear resistant gage elements formed of a material more wear resistant than the matrix material forming a portion of the gage pad. The wear resistant elements have a rounded surface and are embedded in gage pad material proximal a leading edge of the gage pad to provide a rounded wear-resistant edge or surface proximal the leading edge.

82 Claims, 10 Drawing Sheets

FIXED CUTTER DRILL BIT FOR ABRASIVE APPLICATIONS

This application claims the benefit, pursuant to 35 U.S.C. §119(e), of U.S. Provisional Application No. 60/658,534, filed on Mar. 3, 2005.

BACKGROUND OF INVENTION

1. Field of the Invention

The invention relates to fixed cutter drill bits designed for abrasive applications, and more particularly to fixed cutter bits designed for high rate of penetration drilling in unconsolidated ultra abrasive formations.

2. Background Art

Different types of drill bits have been developed and found useful in different drilling environments. Bits typically used for drilling boreholes in the oil and gas industry include roller cone bits and fixed cutter. Cutting structures on bits vary depending on the type of bit and the type of formation being cut. Roller cone cutting structures typically include milled steel teeth, tungsten carbide inserts ("TCIs"), or diamond enhanced inserts (DEIs). Cutting structures for fixed cutter bits typically include polycrystalline diamond compacts ("PDCs"), diamond grit impregnated inserts ("grit hot-pressed inserts" (GHIs)), or natural diamond. The selection of a bit type and cutting structure for a given drilling application depends upon many factors including the formation type to be drilled, rig equipment capabilities, and the time and cost associated with drilling.

In drilling unconsolidated, ultra abrasive formations, bit life is limited due to excessive wear; therefore, bit cost has become a significant factor in the selection of bits for this environment. One example of an unconsolidated, ultra abrasive drilling application includes drilling of the pay zone of heavy oil reservoirs. Heavy oil reservoirs typically comprise unconsolidated to low compressive strength, yet highly abrasive sands that are permeated with thick, dense heavy oil. These dense, high viscosity liquid hydrocarbons are also sometimes referred to as bitumen.

Heavy oil production typically requires special oil recovery techniques, such as the injection of heat and/or pressure into the reservoir to reduce the viscosity of the oil and enhance its flow. One commonly used recovery technique is known as steam-assisted gravity drainage (SAGD), which involves drilling a pair of horizontal wells, typically one above the other, through the reservoir as shown in FIG. 12, wherein the upper well is used for steam injection into the reservoir and the lower well is used to produce the heavy oil. This is further described in Curtis, et al., "Heavy-Oil Reservoirs", *Oilfield Review*, Autumn 2002, pp. 50.

Horizontal wellbores drilled through heavy oil reservoirs often extend 1000 meters or more through the reservoir. To maximize oil recovery in a larger reservoir, multiple directional wells may be drilled from a common wellbore to reduce the distance the oil has to travel through rock to reach a wellbore.

Drill bits used in unconsolidated, ultra abrasive applications are typically damaged beyond repair after a first run due to the extreme abrasion and erosion encountered during drilling. Milled tooth roller cone bits have been considered the most economically feasible bit for these applications because they cost significantly less than other bits and offer more aggressive cutting structures for higher ROP. Fixed cutter bits are generally not used in these applications because they cost 5 to 10 times more than a comparable roller cone bit and typically become damaged beyond repair after a first run, such that their higher cost can not be justified.

Although roller cone bits have been found to be most economically feasible for unconsolidated, ultra abrasive applications, the useful life of these bits is limited. As a result, several bits are typically required to complete a wellbore and the trips back to surface to replace the bits and the number of bits required to complete a well have a significant economic impact on a drilling program. However, up to now, milled tooth bits have still been found to be more economically feasible when compared to the significant cost of using a conventional fixed cutter PDC bit.

What is desired is a fixed cutter drill bit that offers increased useful life in high ROP, unconsolidated, ultra abrasive applications. In particular, such bits may be useful in reducing the number of trips required to complete wellbores in heavy oil drilling applications, or similar applications. Additionally, a drill bit capable of maintaining gage over an extended drilling operation in any highly abrasive environment is desired. Also desired is a more abrasive resistant drill bit that may be used to achieve higher rates of penetration (ROP) to provide a positive economic impact in a drilling program for a heavy oil drilling application.

SUMMARY OF INVENTION

In one aspect, the present invention provides a fixed cutter drill bit providing improved performance in a high rate of penetration unconsolidated abrasive drilling operation.

In one embodiment, the bit includes a bit body having a cutting face and a side portion. The bit body is formed of carbide matrix material. A plurality of blades azimuthally spaced about the cutting face and a plurality of cutters disposed along the blades. At least one gage pad is disposed along a side of the bit body and comprising wear resistant gage elements formed of a material more wear resistant than the matrix material forming a portion of the gage pad. The wear resistant elements include a rounded surface and are embedded in gage pad material proximal a leading edge of the gage pad to provide a rounded wear-resistant edge or surface proximal the leading edge.

In another embodiment, the drill bit includes a bit body, a plurality of blades, and a plurality of cutters is disposed along the blades and arranged to have an extent from a corresponding blade front face of 0.10 inches or less for a majority of the cutters. A majority of the adjacent cutters are also positioned to have spaces there between that are less than 0.25 inches. At least one gage pad is disposed along a side of the bit body. The at least one gage pad has a circumferential width that is at least about 2 inches or results in a total gage pad width equal to 30% or more of the circumference of the bit. At least one wear resistant element is disposed on the gage pad near a leading edge of the gage pad to provide wear resistant protection near the leading edge. Additionally, the bit includes at least one back reaming element positioned on the bit to back ream formation in a path of the bit as the bit is pulled from a wellbore.

Various other aspects and advantages of the invention will be apparent from the following description and the appended claims.

DETAILED DESCRIPTION

Figure 1:
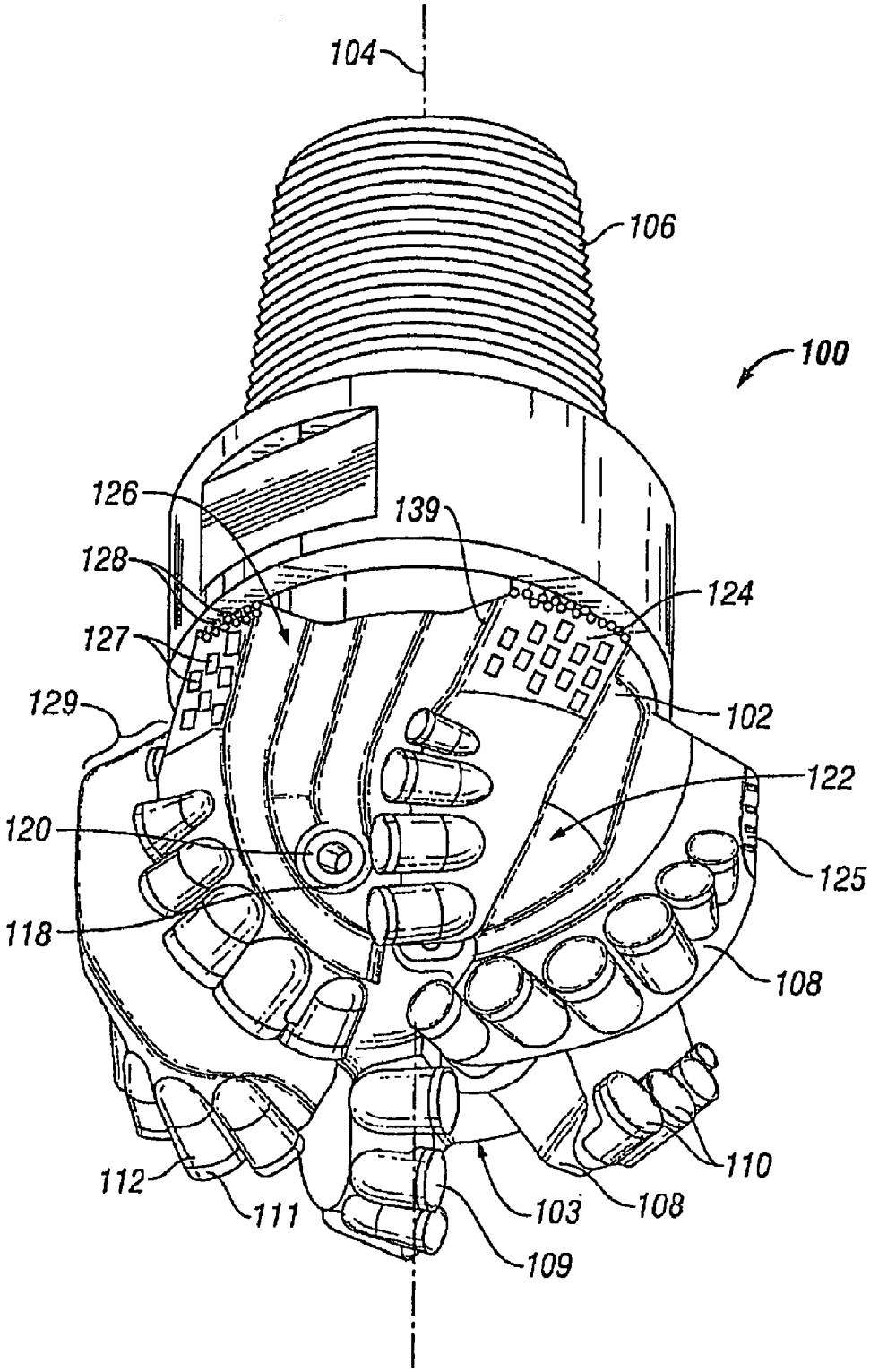
FIG. 1 (PRIOR ART)
FIG. 1 shows is a perspective view of a fixed cutter drill bit illustrating general features of a bit.

Reference will now be made to the figures in which various embodiments of the present invention will be given numerical designations and in which aspects of the invention will be discussed so as to enable one skilled in the art to make and use embodiments of the invention.

In one aspect, the present invention provides a fixed cutter drill bit for drilling earth formations, which may be particularly useful in drilling formations comprising unconsolidated to low compressive strength, yet highly abrasive sands, such as those encountered in heavy oil reservoirs. These types of formations will be generally referred to as "unconsolidated and ultra abrasive" for simplicity. In another aspect, the present invention provides novel gage pad configurations for drill bits, which may be particularly useful on bits designed for any abrasive drilling environment. In another aspect, the invention provides methods for manufacturing or rebuilding fixed cutter bits.

Conventional PDC Bits

Fixed cutter drill bits (also referred to as fixed head bits or drag bits) are significantly more expensive than mill tooth roller cone drill bits and are considered to offer less aggressive cutting structures than roller cone drill bits. However in several applications fixed cutter bits can be used to drill longer well segments in a single run and can be rebuilt and reused multiple times to provide an overall economic benefit that outweighs their higher cost.

Fixed cuter bits which include polycrystalline diamond compact (PDC) cutters are typically referred to as PDC bits. PDC bits can be rebuilt after being used by heating the entire bit to a predefined high temperature and then adding material to areas of the bit where material has been worn away due to erosion or abrasion. Material is typically added by torch welding or the like. Additional heat may also be applied to the cutting structure to melt brazed material around the cutters so that cutters can be rotated to expose an unworn portion of the cutting edge for drilling. When cutters cannot be rotated and reused due to excessive damage or wear, cutters are removed and replaced with new cutters using additional braze material. Bit rebuilding operations are typically carried out as quickly and carefully as possible out to avoid thermal stress cracks in the bit body material. Extensive rebuild operations require repeated thermal cycling of the bit which leads to a higher chance of forming thermal stress cracks. If thermal cracks are found to have developed during a rebuild operation, the bit must be scrapped and a new bit used. Bits can only undergo a limited amount of thermal cycling before developing thermal cracks. Therefore, thermal cycling during a rebuild operation should be limited when possible to extend the useful life of a drill bit.

When considering high rate of penetration (ROP), unconsolidated, ultra abrasive drilling applications, many PDC bits are not designed to provide the ROPs demanded in these applications. PDC bits have also been found to suffer severe material loss in these unique drilling environments where unconsolidated ultra abrasive cuttings mix with drilling fluid, often pumped at high flow rates, to create a highly abrasive/erosive slurry that flows around surfaces of the bit during drilling. The bit tends to ride on the abrasive slurry pumped between surfaces of the bit and the bottomhole, which results in excessive wear on the bit such that bits cannot be rebuilt or reused a sufficient number of times to justify their cost.

In particular, severe erosion has been found to occur between cutters, on cutter substrates, and on the blade faces around the cutters. Severe abrasion has also been found to occur across blade tops, cutter substrates, gage pad surfaces, and blade heel surfaces of the bit. For example, a conventional 12¼ matrix body bit may loose as much as 10 to 12 pounds of material in a single run when used in an unconsolidated, ultra abrasive application. These bits typically cannot be rebuilt or rerun and must be scrapped. In a case where a bit may be rebuilt to attempt a second run, the rebuild operations required are extensive and often result in thermal stress cracks. Also, wear and damage sustained by the cutters are usually such that the cutters cannot be rotated or reused for a second run.

In horizontal drilling applications, the gage pads suffer excessive wear due to constant rubbing action against the formation and the sharp sands in the abrasive slurry flowing past gage pad surfaces. This can cause a bit to go under gage prematurely. Conventional PDC bits also are often less directionally responsive than roller cone drill bits in these applications and have greater tendency to drill out of a desired zone and into bounding formation without any indication at the surface. PDC bits also have gage surfaces that create multiple points of constant hole wall contact which results in bits going undergage prematurely in these environments. Conventional PDC bits have also been found to be more difficult to trip out of horizontal holes after completing their drilling requirement in these environments. This is because cuttings that fail to reach the surface during the drilling tend to fall to the low side of the hole, effectively creating a restricted passage back to the surface. Additionally, conventional PDC bits have been found to be more susceptible to cutter damage when used to drill out cementing shoes and when engaging more competent formations above or below the reservoir pay zone. Damage sustained by conventional PDC bits in these applications leads to costly rebuild operations or the inability to reuse the bit. Thus, conventional PDC bits have not been economically feasible unconsolidated, ultra abrasive drilling applications and are generally not used.

Fixed Cutter Bits for Unconsolidated, Ultra Abrasive Applications

The inventors have studied problems associated with the use of fixed cutter bits in unconsolidated, ultra abrasive drilling applications and have discovered several design features that can be used to significantly extend the life of a fixed cutter drill bit in these applications to provide a positive economic impact on a drilling program.

Examples of the basic features on a PDC bit will now be generally described with reference to the bit shown in FIG. 1. The drill bit 100 includes a bit body 102 which has a central axis 104. The bit body 102 has a connection 106 at one end for connecting to a drill string and a crown formed at the other end which includes a cutting face 103 for cutting through earth formation. A plurality of blades 108 are arranged on the cutting face 103. The blades 108 are azimuthally spaced apart and extend radially and lateral along the cutting face 103. A plurality of cutters 110 are mounted in pockets 109 formed on the blades 108. The cutters 110 are typically attached to the blades 108 by braze material or the like. The cutters 110 are generally arranged in rows along each of the blades 108, with each cutter 110 mounted at a selected radial position relative to the central axis 104 of the bit 100. The cutters 110 are positioned and oriented on the blades to engage with earth formation as the bit 100 is rotated on earth formation under an applied force. The cutters 110 comprise a body of ultrahard material 111 bonded to a substrate 112 which is typically formed of less hard material. Transition layers may also be disposed between the ultrahard body 111 and the substrate 112. The ultrahard body 111 is positioned to form the cutting face 111 for the cutters 110. The ultrahard body 111 typically comprises polycrystalline diamond (PCD), although other ultrahard materials known in the art may be used, such as cubic boron nitride. In the case of PCD, a region or the entire PCD body may be treated to render it thermally stable, such as by removing solvent metal catalyst from a region or the entire body through a suitable process, such as acid leaching, aqua regia bath, electrolytic process, or combinations thereof. One example of a suitable acid leaching method that may be used is disclosed in U.S. Pat. No. 4,224,380, which is incorporated herein by reference. Alternatively, the PCD body may be formed using a catalyzing material, such as silicon, that does not adversely affect diamond bonded grains of the PCD body at elevated temperatures.

A gage region is also formed along an outer side surface 125 of the bit body 102 and includes one or more gage pads 124 having surfaces that extend proximal the gage diameter of the bit 100. One or more gage inserts 127 are embedded in material forming the gage pad 124 to contact the side wall of the wellbore and help maintain the gage diameter being drilled. Gage pads 124 also help to stabilize the drill bit 100 against vibration. In the example shown, a plurality of gage pads 124 are formed at the ends of blades 108 and are spaced apart around the periphery of the bit body 102 with junk slots 126 defined there between. Gage pads which extend around the entire periphery of the body are also known in the art and may be used.

A central longitudinal bore (not shown) which extends into the bit 100 permits drilling fluid to flow from a drill string into the bit 100. A plurality of openings or flow passages 118 are positioned in the cutting face 103 of the bit 100 and in fluid communication with central bore. The flow passages 118 are configured for mounting nozzles 120 therein which serve to distribute drilling fluid around the cutters 110 and cutting face 103 of the bit body 102. The nozzles direct fluid to flush formation cuttings away from the cutting structure and borehole bottom during drilling. Grooves or channels 122 between the blades 108 serve as drilling fluid flow courses for directing drilling fluid and cuttings radially outward away from the cutting face 103. The junk slots 126 between the gage pads 124 of the bit 100 are in fluid communication with the channels 122 and permit drilling fluid and formation cuttings to flow away from the cutting face 103 and up an annulus formed between the drill string and the wall of the borehole during drilling.

In this example, small hard elements 128 are also provided along on a heel surface 129 of the bit 100 to help "back ream" or remove formation in the path of the bit as the bit 100 is pulled from the borehole.

Matrix Body Bit

Figure 2:
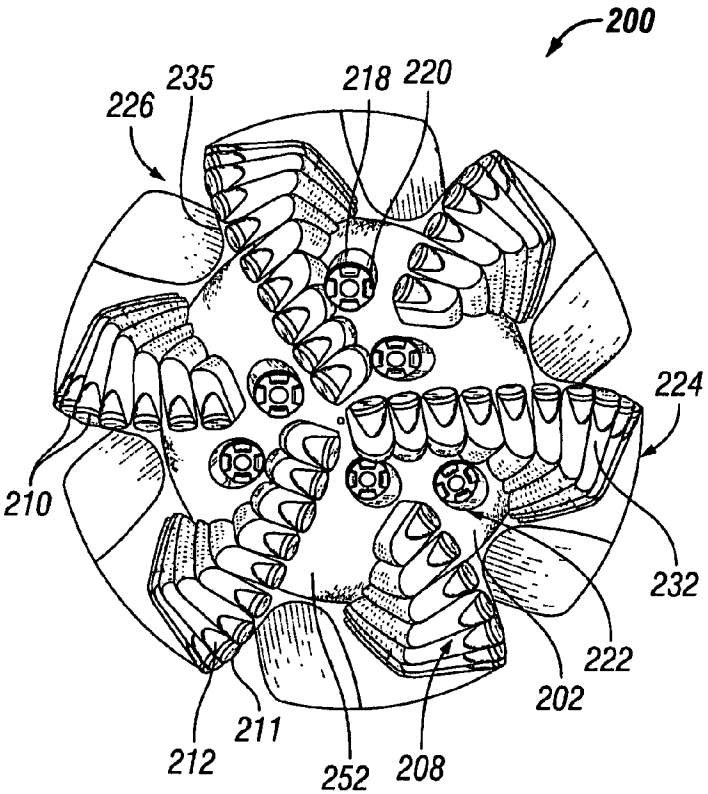
FIG. 2 shows a plan view of a cutting face for a PDC bit in accordance with one embodiment of the present invention.

Features of embodiments of the invention will now be described with reference to FIG. 2. FIG. 2 shows one example of a cutting face design for a drill bit in accordance with aspects of the present invention. The bit body 202, blades 208 and gage pads 224 in this embodiment are generally formed of matrix material to provide greater abrasion and erosion resistance than conventional steel bodies. The matrix material may comprise tungsten carbide infiltrated with binder material. The matrix bit may be formed in any conventional manner known in the art, such as by packing a graphite mold with a mix of tungsten carbide powder and then infiltrating the powder with a molten alloy binder in a furnace and allowing it to cool to form a hard metal cast matrix body. Examples of methods and materials for forming matrix body bits are further described in U.S. Pat. Nos. 5,662,183, 6,287,360, and 6,375,706 which are all assigned to the assignee of the present invention and incorporated herein by reference. While reference is made to tungsten carbide powder above, the powder may also include other materials, such as nickel, iron, cobalt, and/or other various alloys. A matrix bit may be formed using other transition metal carbides, such as molybdenum, niobium, tantalum, hafnium, and vanadium.

Ultrahard Cutters

Any cutters suitable for abrasive drilling applications may be used in accordance with embodiments of the present invention. In the embodiment shown in FIG. 2, the cutters comprise a table or body of ultrahard material 211 bonded to a substrate 212 of less hard material. Typical cutters used are polycrystalline diamond compact (PDC) cutters, wherein the ultrahard material 211 comprises a polycrystalline diamond table and the substrate 212 comprises tungsten carbide. Other embodiments may comprise cutters 210 formed of any ultrahard material and substrate material suitable for drill bit cutters, including polycrystalline diamond, polycrystalline cubic boron nitride, tungsten carbide, combinations thereof, or other metal carbide.

PDC cutters can be formed by placing a cemented carbide substrate or components for forming a carbide substrate into a press container. A mixture of diamond grains or diamond grains and catalyst binder is then placed on top the substrate and the container assembly is subjected to high pressure, high temperature conditions such that the metal binder migrates from the substrate and through the diamond grains to promote bonding of the diamond grains to each other to form the diamond layer, subsequently bonding the diamond layer to the substrate. The catalyst or binder material commonly used includes cobalt. The catalyst material may later be removed or depleted from the working surface of the cutter for enhanced abrasion resistance. One or more intermediate layers of material may also be disposed between the diamond layer and the substrate, as is known in the art. Additionally, the cutter may include a non-planar interface between the diamond layer and substrate.

In one or more embodiments of the present invention, larger cutters are used on the bit to allow for higher rates of penetration. In one or more embodiments, cutters having a diameter of 16 mm or larger are disposed along the blades of the bit. For the example embodiment shown in FIG. 5C, 16 mm and 19 mm cutters were used.

Cutter Placement

Many PDC bit designs have cutters spaced apart along the blades and positioned to extend from a front of the blade front face. However, these cutter arrangements can lead to increased recirculation of abrasive slurry around the cutters and blades and excessive abrasive and erosive wear on the cutters, blades, and braze material. Therefore, as shown in FIG. 2, cutters 210 are preferably placed closer together along the blades 208. By reducing the amount of space between adjacent cutters 210 less abrasive slurry is allowed to flow between cutters and across the blade tops 232, which can significantly reduce wear on the cutting structure.

Therefore, cutters 210 are preferably arranged on the blades 208 such that adjacent cutters on a blade 208 have a spacing there between of 0.25 inches or less. In selected embodiments, this spacing may be closer to around 0.040 inches or less and may be applied to a majority of adjacent cutters 210 on the blades 208 where possible. Arranging cutters 210 closer together along the blades 208 also provides greater ultrahard coverage along the leading edge of the blades 208 which leads to an overall reduction of wear on cutters. Reducing the spacing between cutters to 0.25 inches or less, and more preferably to 0.10 inches or less, can help reduce wear on the blade s 208 and the cutters 210, such that less material is lost from the bit during drilling. This can help a bit effectively handle longer drilling runs and extend the useful life of the bit. In particular, this can reduce the time and number of thermal cycles required for a rebuild operation.

Figure 4A:
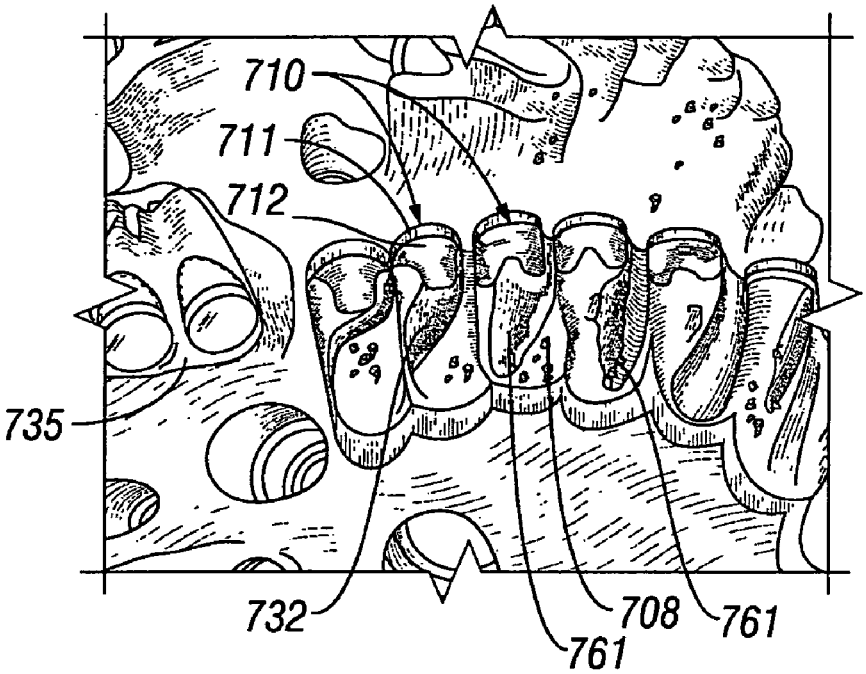
FIG. 4A-4B shows wear marks on the blades tops of a PDC bit having spiral blades after a drilling run in an unconsolidated, ultra abrasive environment.
Figure 4B:
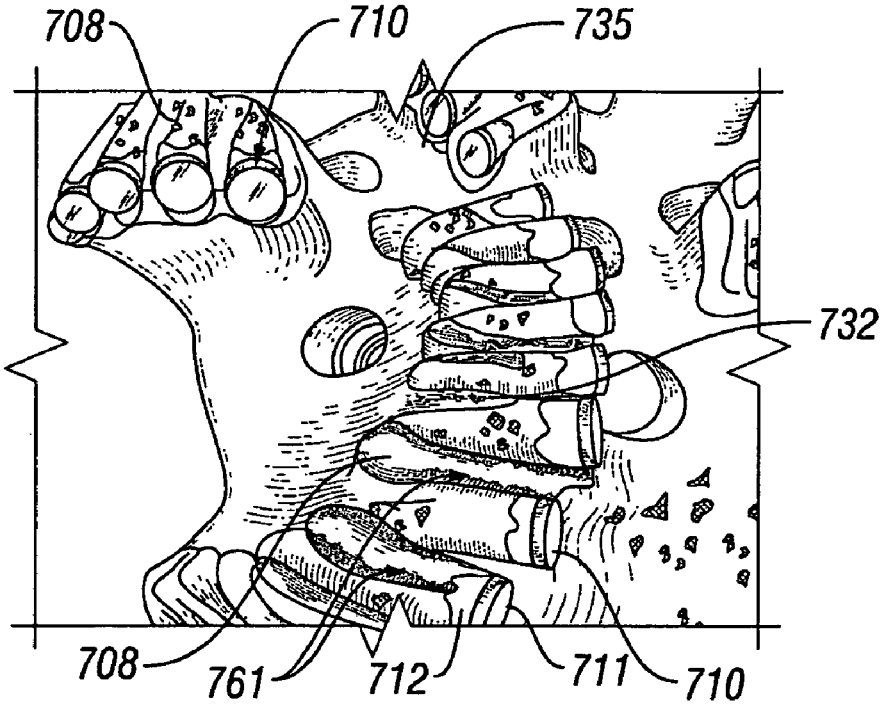

In one or more embodiments, blades 208 of the bit 200 are also preferably formed to have a limited helix from cutter to cutter. Referring to FIGS. 4A and 4B, increased blade spiraling typically requires that the cutters 710 be physically spaced further apart at the front face 735 of the blades 708 due to space limitations at the bases of the cutters. Additionally, when a significant degree of spiral is applied to cutters along a blade, wear occurs on the tops of the blades 708. Corresponding spiraled wear grooves 761 have been found to form across blades tops 732 due top abrasive slurry flowing in a spiraled pattern between cutters 710. This can also result in increased erosion on cutter substrate 712 for some bit designs. By minimizing the helix spiral of the blades 708 or the cutters 710, cutters 710 can be spaced closer together along the blades 708 to minimize erosive wear on the bit. Therefore, in one or more embodiments, a blade helix angle may be limited to 5° to allow for a closer spacing of cutters and to help reduce wear on the bit. In other cases, helix angles may be limited to 3° or less, and in some cases 1° or less may be preferred.

Referring again to FIG. 3, the inventors have also found that by placing cutters 210 on the blades 208 with a limited extension from a blade front face 232 can also help to reduce wear on the cutting structure of the bit. By restricting the extent of cutters 210 from the blades 208 to 0.10 inches or less, abrasive wear around the cutters 210 due to recirculation of the abrasive slurry can be reduced. In selected embodiments, cutter extents of 0.06 inches or less may be used, and in some cases 0.03 inches or less may be preferred. In the embodiment shown in FIG. 3, the cutters are substantially flush with the blade front face 235. In another embodiment, one or more of the cutters may be set recessed from the blade front face.

Figure 5A:
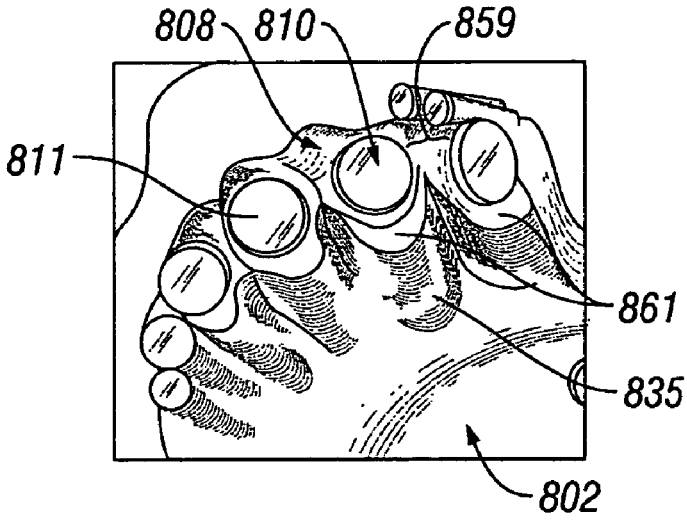
FIGS. 5A-5B show a close up view of a blade of a PDC bit used for a drilling run in an unconsolidated, ultra abrasive environment.
Figure 5B:
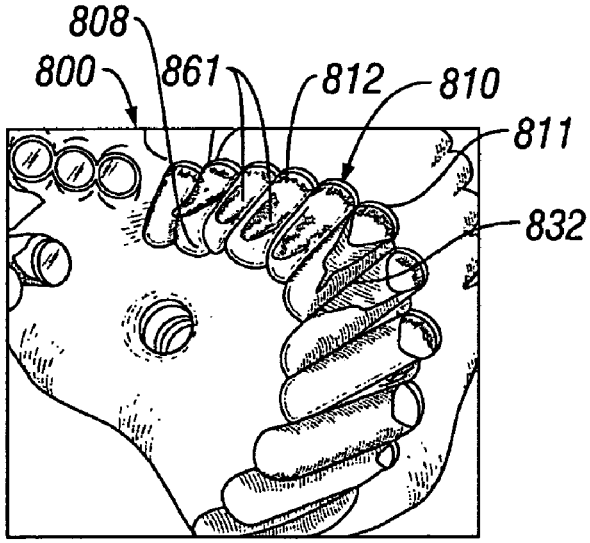
Figure 5C:
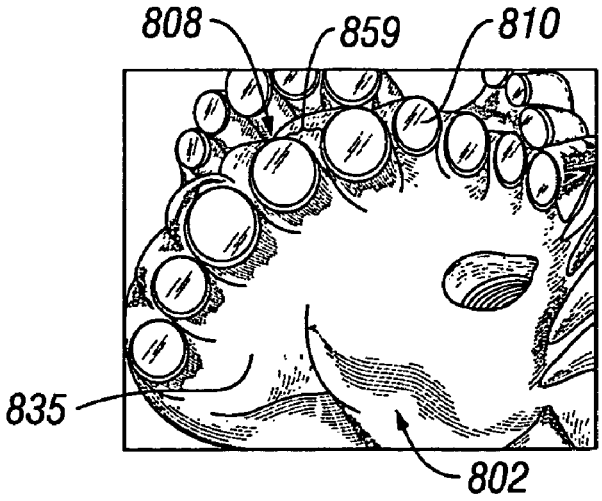
FIG. 5C shows a close up view of a blade on another PDC bit used for a drilling run in an unconsolidated, ultra abrasive environment, wherein the blade spiral and spacing between cutters was reduced compared to the bit in FIGS. 5A-5B and resulted in reduced wear of matrix material from around the cutters.

Examples of test bits used for a drilling run in an unconsolidated, ultra abrasive formation are shown in FIGS. 5A-5C. FIG. 5A shows a close up view of a first bit used, wherein adjacent cutters 810 were spaced further apart along the blade front face 835 than the cutters on a second bit shown in FIG. 5C. The cutter spacing 859 for the bit in FIG. 5A is partially due to an increased spiral of the blades 808 in this design, as shown in FIG. 5B. The bit in FIG. 5C had substantially straight blades and a smaller spacing 859 between adjacent cutters 810. The cutter arrangement shown in FIG. 5A resulted in more matrix material erosion on the front face 835 of the blades 808 below and between the cutters 810 than for the bit shown in FIG. 8C. Wear was also noted on cutter substrates 812. B reducing the helix and minimizing the amount of space between cutters, less abrasive flow was directed between and around the cutters and wear on the cutting structure was reduced.

Thicker Blades and Gage Pads

In one or more embodiments, the bit also includes thicker blades and gage pads which may also help to increase the useful life of the drill bit in ultra abrasive applications. For example, referring to FIG. 3, the gage pads 224 in this embodiment are configured to span a circumferential width, w, of at least about 2 inches at a point along their length. However, in other embodiments, gage thickness will depend on the number of gage pads in the bit design and the diameter of the bit. Therefore, in other embodiments, the gage pads may be arranged around the bit to provide a total width of gage surface around the bit that is greater than or equal to 30% of the circumference of the bit. For example, a six blade, 12¼ inch diameter bit may be configured to have six gage pads, each with a gage with, w, of between about 2 and 3½ inches, such as around 2½ inches or more, resulting in a total gage pad width of 15 inches or more which is around 39% of the circumference of the bit.

Space available for blade thickness is limited near the crown of the bit 200. However, in one or more embodiments, the blades 208 may be configured to increase in thickness in a direction away from the center of the bit 200 toward the gage pads 224. The blade thickness will generally depend on the diameter of the bit 200 and the number of blades 208 in the bit design. Therefore, in one or more embodiments, the number of blades on the bit may be limited to eight blades or less, and in many cases six blades or less to allow for thicker blades as well as higher ROPs. However, for the six bladed, 12¼ inch bit described above, the blades 208 can be generally configured to increase in thickness along their length toward the gage region to a width close to the selected width of the gage pad.

Figure 3:
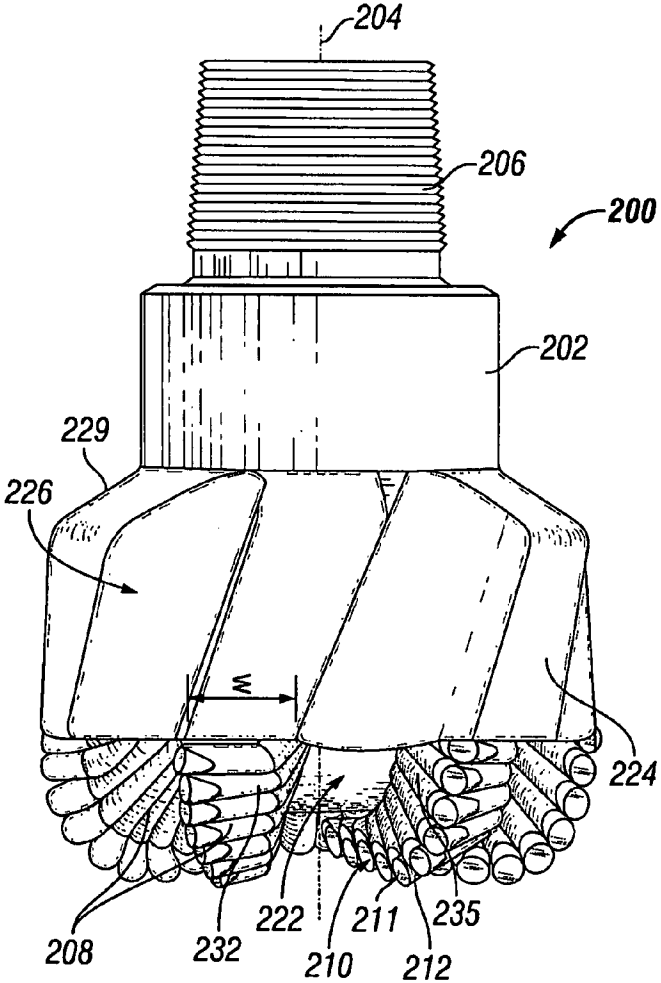
FIG. 3 shows a perspective view of the cutting face of the PDC bit shown in FIG. 2.

In the embodiments shown in FIGS. 2 and 3, the blades supporting the gage pads 224 are formed continuous with the cutting structure blades (208). In other embodiments, space may be provided between the blades 208 extending from the crown of the bit 200 and the blades or structure supporting the gage pads 224 on the side of the bit body 202. Additionally, a bit may be configured to have a single gage pad that extends around the periphery of the bit with junk slots provided between the bit body and gage pads; however in many applications a bit having a plurality of gage pads spaced apart with substantially unrestricted junk slots there between may be preferred.

The inventors have determined that providing increased blade thickness can increase the number of rebuild operations a bit can undergo before developing thermal stress cracks. Thicker blades and gage pads have been found to retain heat better during rebuild operations such that more rebuild work can be done in a single heat cycle and the number of thermal cycles required during a rebuild operation can be reduced. Additionally, blades and gage pads that are initially thicker than structurally required increase the chances of the bit being structurally sound for a second run before needing to be rebuilt. This can also reduce the time required for a rebuild operation because less material will need to be added to the bit to place it into a structurally sound rerunable condition. As a result, both the rerunability (ability to rerun the bit) and the repairability (ability to repair the bit multiple times) can be increased to enhance the economic feasibility of fixed cutter bits in unconsolidated, ultra abrasive drilling applications.

Figure 6A:
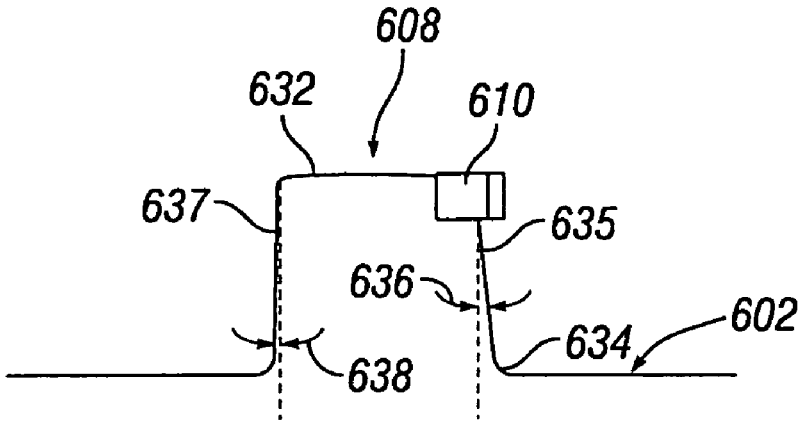
FIG. 6A shows a cross section geometry of a conventional blade for a PDC bit.
Figure 6B:
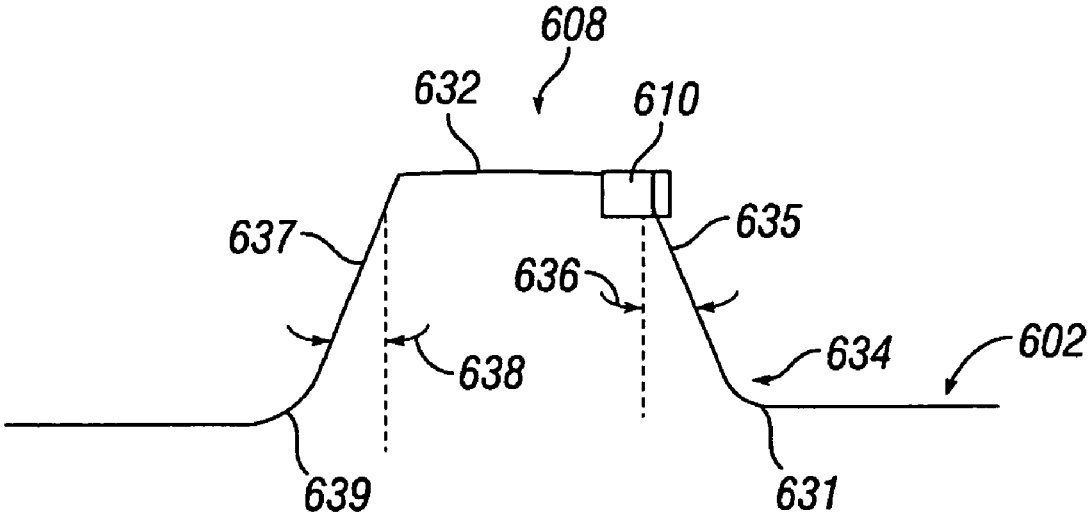
FIG. 6B shows a cross section geometry of a blade for a PDC bit in accordance with one embodiment of the invention.

Referring now to FIGS. 6A and 6B, in one or more embodiments, a drill bit may also be configured to include a radius corner at the base of a blade between the blade and the bit body where thermal stresses tend to build up during a rebuild operation. As shown in FIG. 6A, PDC bits may be designed to have a sharp corner at the blade base 634 where the blade front faces 635 or blade back faces 637 join with the bit body 602. When the faces are substantially perpendicular to the bit body, this is considered a 0° blade front face angle or blade back face angle. High thermal stresses have been found to develop in these sharp corners during rebuild operations. Therefore, referring to FIG. 6B, in one or more embodiments, a bit may be configured to have more rounded corners at the base 634 of blades 608. For example, the blade front face 635 and/or the blade back face 637 may be configured to have a larger blade front face angle 636 and/or blade back face angle 638 so that a larger radius of curvature (655, 657) is formed at the base 634 of the blade 608. Alternatively, the blades may be formed to include a desired radius of curvature (655, 657), such as a radius of curvature of around 0.375 inches or more. In one or more embodiments, bits may be designed to have blade front angles 636 or blade back face angles 638 of 1° or more, and in some cases of at least about 5° or more. In one embodiment the blades were configured to have blade front face and back face angles of around 10°. Providing a radius at the base of one or more blades can help reduce the chance of developing thermal stress cracks in that area during repeat rebuild operations.

As shown in FIG. 6B, in some embodiments one or more of the blades 608 may be configured to increase in thickness from the blade top 612 to the blade base 634 to provide a more robust blade for handling longer runs or a greater number of runs before needing to be rebuilt. Also, as noted above, thicker blades have been found to retain heat better during rebuild operations and may reduce the thermal cycling required to rebuild a bit. This can also increase in the number of rebuild operations a bit can undergo before developing stress cracks. In some cases, drill bits having blade tops that increase in width in a radial direction toward gage and increase in width in an axial direction toward the base of the blade may be desired for enhanced rerunability and repairability in heavy oil drilling applications.

Increased Wear Resistant Surfaces

Additionally, in one or more embodiments, matrix materials used to form outer surfaces of the bit body, blades, and/or gage pads may be selected to provide increased wear resistance over other matrix materials commonly used for PDC bits in applications, such as high impact applications. For example, matrix materials having a higher hardness or higher carbide content may be used to provide increased wear resistance. Alternatively, the wear resistance of matrix material can be increased by using more fine grain carbide powder to form the matrix. This can also result in a higher carbide content and lower binder content when the matrix body is formed. For example, a tungsten carbide matrix powder used to form portions of the bit body, blades, and/or gage pads may include a higher percentage of fine tungsten carbide particles to achieve an average tungsten carbide grain size of 60 μm or less, and in some cases 50 μm or less. Alternatively, the matrix powder used may include at least about 30% by weight tungsten carbide with an average particle size between about 0.2 μm and 30 μm to provide a higher packing density to achieve increased wear resistance and strength. In selected embodiments, this amount is at least about 40% by weight, and in some cases, at least about 50% by weight.

The wear resistance of matrix material can also be increased by using a greater amount of particular types of tungsten carbides to form the matrix powder. Types of tungsten carbides generally include macro-crystalline tungsten carbide, cast tungsten carbide, carburized tungsten carbide and sintered tungsten carbide. Matrix powders typically include two or more of the aforementioned types of tungsten carbide combined in various weight proportions. Matrix powders may also include other metal additives, such as nickel (Ni), iron (Fe), cobalt (Co) or other transition metals. The wear resistance of matrix material can be increased by using a greater amount of a harder tungsten carbide in the matrix powder. For example, more cast carbide may be used in the matrix powder. In selected embodiments, cast carbides in amounts of around 40% or more by weight, and in some cases 45% or more, have be used to provide increased wear resistance over conventional matrix materials.

Additionally, in one or more embodiments, cutters used on the bit may be selected to have more wear resistant substrates. Wear resistance of substrate material also increases with hardness or carbide content, or by decreasing the binder contents or tungsten carbide grain size. Therefore, in one embodiment, cutters with substrates having hardness of 88 Ra or more may used. Alternatively, cutters having substrates with a binder content of around 13% or less by weight may be used. Also, in one embodiment, substrates may be formed using tungsten carbide particles with an average grain size of around 3 microns or less to provide increased wear resistance. Alternatively, cutters 210 may be treated or a coating applied to exposed surfaces of cutter substrates to reduce wear in selected embodiments.

Enhanced Wear Resistance Along Surfaces

To provide increased wear resistance along surfaces of the bit subjected to the greatest amount of wear, selected portions on the bit, such as the bit body 202, blades 208, or gage pads 224, may be formed using different matrix materials to obtain the increased wear resistance desired without sacrificing impact toughness or crack resistance of the bit body. Examples of this are described in U.S. patent application Ser.

No. 10/454,924 to Kembaiyan, titled "Bit Body Formed of Multiple Matrix Materials and Method for Making the Same," which is assigned to the assignee of the present invention and incorporated herein by reference. Referring to FIG. 3, for example, the blade tops 232 and surfaces of the gage pad 224 can be formed to include an outer layer of matrix material having a higher wear resistance than an underlying layer which may provide higher toughness.

Additionally, ultrahard material can be deposited along surfaces of the bit body to reduce wear of matrix material in selected regions. For example, a coating comprising ultrahard material, such as a plated diamond coating, may be applied to surfaces of the bit, such as along the blades 208, gage pads 224, or cutter substrates 212 to increase the wear resistance along those surfaces. Such coatings may be used to help reduce wear on bit body surfaces and to allow for longer bit runs.

Figure 7A:
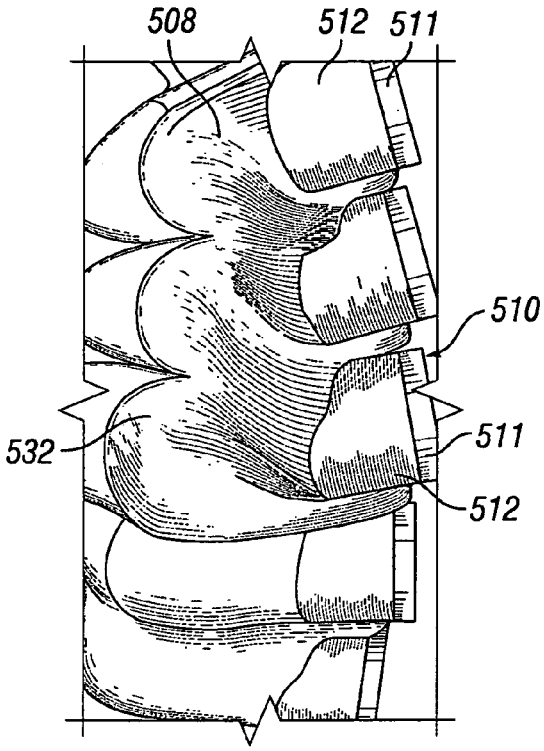
FIG. 7A shows a blade top for a PDC bit without wear resistant material embedded in its blade tops or cutter substrates after a first run in an unconsolidated ultra abrasive environment.
Figure 7B:
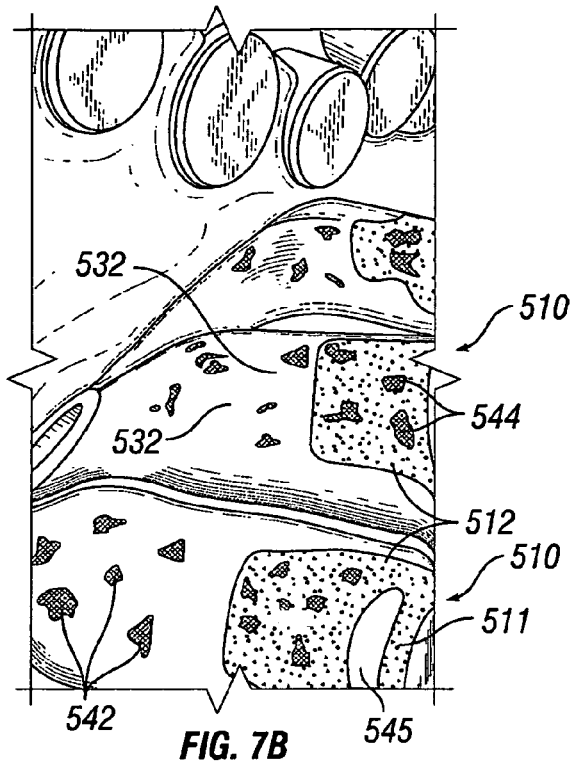
FIG. 7B shows a blade top for a PDC bit similar to the one shown in FIG. 7A but with the addition of wear resistant material embedded in the blade tops and cutter substrates after a first run in an unconsolidated ultra abrasive environment.
Figure 7C:
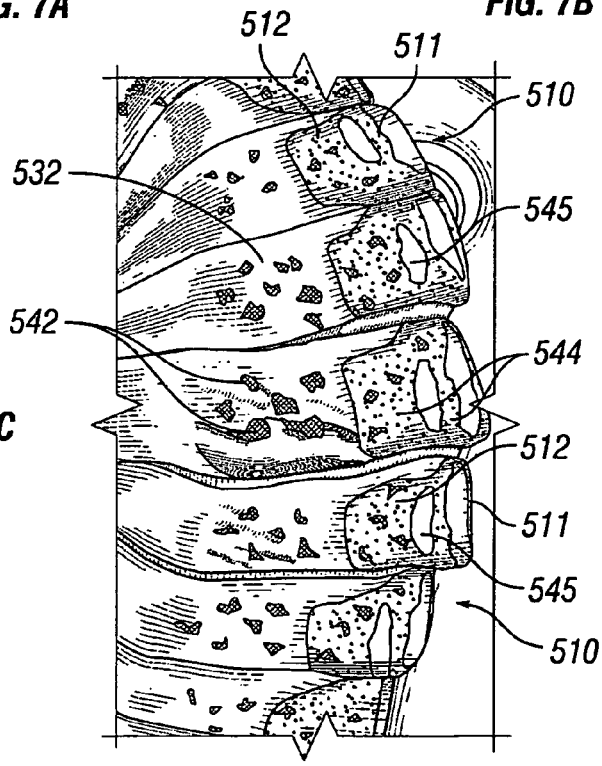
FIG. 7C shows the condition of the blade top shown in FIG. 7B after four bit runs.

Alternatively, ultrahard particles or elements may be embedded in outer surfaces of the bit to increase the abrasion and erosion resistance of these surfaces. For example, ultrahard material can be embedded in blade tops and cutter substrates to further reduce wear during drilling. Test bits run in a high flow rate unconsolidated, ultra abrasive application both with and without ultrahard material embedded in blade tops and cutter substrates are shown in FIGS. 7A-7C. The bit shown in FIG. 7A was configured in accordance with aspects of the invention and used to drill a wellbore segment through a heavy oil reservoir with high drilling fluid flow rates. This bit did not include ultrahard material embedded in the blade tops 532 or cutter substrates 512. As shown in FIG. 7A, when the bit was pulled to the surface after a first run, the bit was found to have reduced but noticeable wear across the blade tops 532 and exposed cutter substrates 512.

The bit shown in FIG. 7B has the same design as the bit in FIG. 7A but includes the addition of ultrahard particles 542, 544 embedded along the blade tops 532 and in the cutter substrates 512. This bit was used under similar conditions substantially equivalent to the one shown in FIG. 7A. As shown in FIG. 7B, when the bit with ultrahard particles 542, 544 embedded in therein was pulled to the surface after a first run, significantly less wear was found across the blade tops 532 and cutter substrates 512. The ultrahard particles used in this embodiment were natural set diamonds, having grain sizes of around 1-3 mm or more (1-10 stones per carat ("spc") or less). A band of ultrahard material 545 was also embedded in the substrate material 512 behind the diamond table (ultrahard body 511) of the cutter, as further described in U.S. Pat. No. 6,272,753 to Scott, which is assigned to the assignee of the present invention and incorporated herein by reference. The addition of ultrahard material in the blade tops 532 and in the cutter substrates 512 was found to significantly reduce the amount of matrix material loss from the bit during drilling.

FIG. 7C shows the condition of the bit in FIG. 7B after a fourth bit run. The blade tops 532 and cutter substrates 512 with the embedded ultrahard material (542, 544, 546) were found to be in better condition than the bit run without embedded ultrahard material (shown in FIG. 7A). Adding ultrahard elements in surfaces of the bit subjected to the highest amounts of wear may significantly reduce the amount of matrix material worn from a bit in a given run and may also help to lengthen the effective life of the bit in a drilling program.

In other embodiments where ultrahard particles or elements are embedded or infiltrated into the matrix material forming surfaces of a bit, the ultrahard material may be natural or synthetic diamond, or a combination of both, and can be obtained in a variety of shapes and grades as desired. Other ultrahard material particles or elements known in the art may also or alternatively be used. In such cases, the matrix material should be selected to provide sufficient abrasion resistance so that ultrahard particles or elements are not prematurely released.

Along surfaces, such as the blade tops, larger ultrahard particles or elements can used, as desired, to allow for prolonged retention in matrix material due to increased grip area around the particles for matrix material to hold them in place longer. For example, in selected embodiments the blade tops and other surfaces on the bit can be impregnated with diamond grit of any grain size. In one embodiment, diamond grit having a grain size of around 700 μm or more (150 spc or less) was used for prolonged resistance. In another embodiment, diamond grit having a size of around 850 μm more (100 spc or less) were used.

Alternatively, ultrahard particles embedded in the matrix material may be disposed both at and below the outer surface of the matrix material for prolonged abrasion resistance. Ultrahard particles infiltrated in matrix material to a selected depth beneath surfaces of the bit may be provided so that as the matrix material wears and ultrahard particles at the surface fall but, additional particles will become exposed below the surface for prolonged abrasion resistance. Bits having surfaces infiltrated with ultrahard particles to a selected depth maintain their ability resist abrasion and erosion for longer periods of time, even after surface particles are worn down, which can also increase the length or number of runs a bit can be used for before having to be rebuilt.

Ultrahard particles or elements embedded in matrix material may also be coated to achieve a stronger bond in matrix material. Examples of coatings that may be used are described in U.S. application Ser. No. 10/928,914 to Oldham, filed Aug. 26, 2004, titled "Coated Diamond for Use in Impregnated Diamond Bits," assigned to the assignee of the present invention and incorporated herein by reference.

As noted, ultrahard elements formed of any abrasion resistant material may be embedded in the blade tops behind the cutters or along other surfaces of the bit. Examples of ultrahard elements that may be used include diamond grit-hot pressed inserts (GHIs), PCBN elements, and TSP elements. For example, GHIs or other elements containing abrasive resistant material can be placed behind the cutters, such as similar to that described for example in U.S. Pat. Nos. 4,823,892, 4,889,017, 4,991,670 or 4,718,505. GHIs may be infiltrated or brazed into surfaces of the bit, as discussed in U.S. Pat. No. 6,394,202, to Truax and assigned to the assignee of the present invention.

A bit having selected surfaces impregnated with ultrahard particles or elements, as described above, can be formed by placing the ultrahard particles or elements in predefined locations of a bit mold. Alternatively, composite components, or segments comprising a matrix material infiltrated with diamond particles or the like can be placed in predefined locations in the mold. Once the ultrahard material or components are positioned, other components for forming the bit can be positioned in the mold and then the remainder of the cavity filled with matrix material, such as a charge of tungsten carbide powder. Finally, an infiltrant or binder can be placed on top of the matrix powder and the assembly then heated sufficiently to melt the infiltrant for a sufficient period to allow it to flow into and bind the powder matrix and segments. Using this process, a bit body that incorporates the desired ultrahard particle containing sections and/or components can be formed.

As discussed above and shown in FIGS. 7B and 7C, ultrahard particles 544 and/or ultrahard elements 546 (e.g., a band of ultrahard material) can also be embedded in cutter substrates 512 for increased wear resistance along an exposed portion of the substrate 512. Ultrahard particles embedded in the substrate 512 or in matrix material surrounding the cutters may comprise particulate diamond or diamond grit, which may be natural or synthetic, or other ultrahard particles known in the art. Ultrahard elements used may comprise polycrystalline diamond (PCD), polycrystalline cubic boron nitride (PCBN), grit hot-pressed inserts (GHIs), or other ultrahard material elements known in the art.

Referring to FIG. 3, wear on cutter substrates 212 can also be reduced by limiting the amount of cutter substrate 212 exposed to abrasive slurry during drilling. Therefore, in one or more embodiments, cutters 210 with shorter substrates 212 may be used or the cutters 210 positioned in the blade pockets 209 with less than the full length of the substrate exposed. For example, cutters may be positioned to have exposed substrate lengths of 16 mm or less. In some cases, exposed substrates lengths may be limited to less than 13 mm, and in one or more cases, to 9 mm or less.

Cutting Arrangements

The cutters of the bit shown in FIGS. 2 and 3 are generally arranged in a short parabolic profile for to provide enhanced steerability for horizontal drilling in unconsolidated, ultra abrasive formations. The cutters are also arranged to minimize an imbalanced force on the bit and a difference in the work rates of the cutters. In other embodiments, any bit profile or cutter arrangement may be used.

The cutters can also be arranged at a back rake angle to provide enhanced steerability when desired for particular horizontal drilling applications, such as for drilling the pay zone of a heavy oil reservoir. Cutters oriented with back rake provide a less aggressive cutting structure which may be more resistant to drilling out of the pay zone of drilling heavy oil reservoirs which are typically bounded above and below by more consolidated formations. In particular, the responsiveness of the bit to a formation change increases with back rake such that if a more competent formation is encountered during drilling the bit will be more prone to skip or bounce along the bounding formation and remain in the desired drilling zone. Also cutters with higher back rake are less likely to sustain damage when drilling float equipment or a shoe in the path of the bit, such as at the start of horizontal drilling section. Providing a bit that is more sensitive to formation changes can also reduce drilling costs by obviating the need for directional equipment in these applications. For unconsolidated, ultra abrasive applications, bits having higher back rakes may be used because the rate of penetration of these bits is not a limiting issue in these applications. Additionally, a bit's sensitivity to formation changes may be further increased by using a short parabolic profile along with increased back rake angles.

Figure 8A:
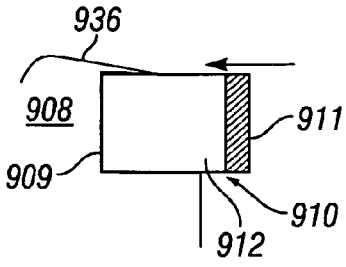
FIGS. 8A-8C show a cutter oriented on a blade at a selected back rake angle in accordance with one embodiment of the present invention.
Figure 8B:
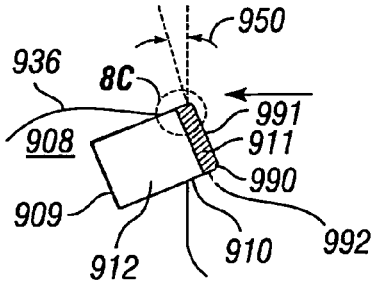

Orienting cutters at a back rake angle can also help reduce erosion on cutter substrates 212. For example, as shown in FIG. 8A, a cutter 910 mounted on a blade 908 with zero back rake, is exposed to abrasive slurry passing over the cutting edge of the cutter 910 during drilling. By orienting a cutter 910, as shown in FIG. 8B, at a selected back rake angle 950, substrate exposure to abrasive slurry can be reduced and exposure of the ultrahard body 911 to the abrasive formation can be increased. This may also increase the area in the blade pocket 909 for bonding cutters 910 to the blade 908. In selected embodiments, the cutters may be oriented with a back rake angle of 20° or more. In an embodiment similar to the one shown in FIG. 3, cutters have a back rake distribution such that near the center of the bit are oriented with back rake angles of around 20° which increased towards gage to cutters oriented with back rake angles of about 30° or more near gage.

In one or more embodiments, one or more cutters may be oriented at a selected a side rake angle. For example, cutters may also be oriented at a side rake angle toward the outside of the bit that is greater than 0°. Providing cutters oriented to include a side rake angle may help increase a bits resistance to drilling out of a desired formation zone and may also help to direct abrasive cuttings away from the bit for enhanced cuttings evacuation and reduced wear.

Figure 8C:
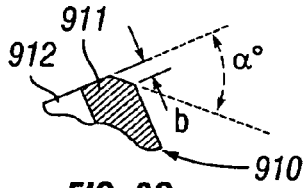

Referring to FIG. 8C, cutters may also include a bevel or chamfer 990 that extends from a periphery of the top surface 991 of the ultrahard body 911 to the sidewall 992 of the ultrahard body 911. The chamfer 990 may extend about the entire periphery of ultrahard body 911, or only along a periphery portion adjacent the formation to be cut. Chamfers may be any size and different sized chamfers may be used in different locations on selected embodiments. In selected embodiments similar to that shown in FIG. 2, cutters having chamfer lengths of 0.012 inches (measured along the side of the cutter) oriented at around 45° (with respect to the side of the cutter) were used for enhanced impact resistance. In selected embodiments, cutters with larger bevels may be used, such as for drilling through shoes and equipment in a wellbore. For example, cutters having a bevel size greater than or equal to 0.025 inches may be used.

Improved Gage Protection

When conventional fixed cutter bits are used in unconsolidated, ultra abrasive applications they suffer excessive wear along the gage pads due to rubbing action against the formation and abrasive slurry flowing past gage surfaces. Therefore, in accordance with embodiments if the present invention, a fixed cutter drill bit for unconsolidated, ultra abrasive environments also includes wear resistant elements, such as diamond or ultrahard material containing elements, embedded in gage pad surfaces to provide enhanced wear resistance at gage.

For selected embodiments, especially those designed for long runs in high flow rate directional drilling applications, additional gage pad protection may be required. In these applications, abrasive slurry containing sharp sands tends to abrade matrix material along the leading edge which exposes inner regions of the gage pad to a greater amount of abrasive wear. As a result, matrix material around the wear resistant elements in the pad may eventually become worn away causing the wear resistant elements to fall out.

Therefore, in selected embodiments, wear resistance of a gage pad may be increased by placing wear resistant elements proximal a leading edge of the gage pad to serve as a barrier to abrasive slurry impacting the leading edge. Wear resistance may also be increased by providing a greater amount of diamond coverage on the gage pad. This is done by using larger wear resistant elements with longer substrates or extensions for embedding into the matrix material to increase the ability of the gage pad to retain the wear resistant elements during drilling.

Figure 9:
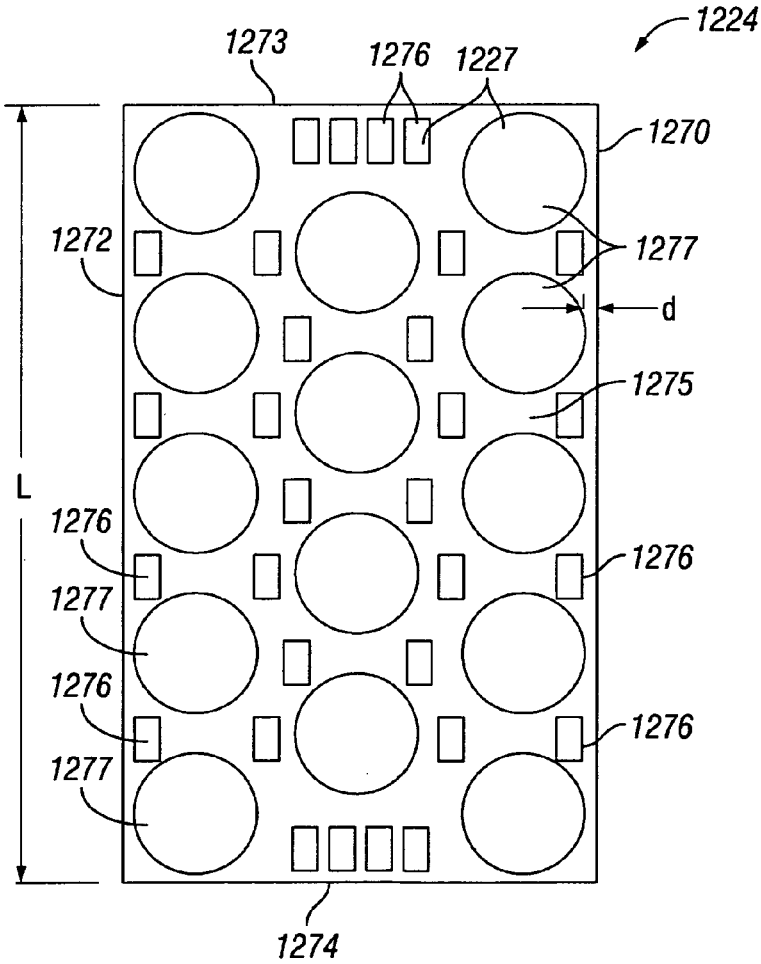
FIG. 9 shows one embodiment of a novel abrasive resistant gage pad configuration which may be used on a PDC bit in accordance with one or more embodiments of the present invention.

One example of a novel abrasive resistant gage pad arrangement that may be used on an embodiment of the invention described above to enable longer drilling runs or on any PDC bit for enhanced abrasive resistance is shown in FIG. 9. In this embodiment, the gage pad 1224 includes wear resistant elements 1227 which are embedded in the gage pad material 1275. The gage pad material 1275 comprises a carbide matrix, such as tungsten carbide infiltrated with binder material. A number of the wear resistant 1227 elements are embedded in the matrix material close to the leading edge 1270 of the gage pad 1224. The wear resistant elements 1227 disposed proximal the leading edge 1270 are positioned around ¼ inch or less away from the leading edge 1270 and arranged span a majority of the length of the leading edge 1270. A plurality of the wear resistant elements 1227 are also disposed along a tailing edge 1272 of the gage pad 1224 and along a top edge 1273 and a bottom edge 1274 of the gage pad 1224 to provide enhanced wear resistance along these edges. Wear resistant elements 1227 positioned near the trailing edge 1272 are positioned around ¼ inch or less away from the trailing edge 1272 and span a majority of the length of the trailing edge 1272. A plurality of the wear resistant elements 1227 are also provided in the interior region of the gage pad to provide a large amount of overall wear resistant coverage on the gage pad 1224.

The wear resistant elements 1227 in the embodiment shown in FIG. 9 include large wear resistant elements 1277 and smaller wear resistant elements 1276 positioned around the large wear resistant elements 1277. The larger elements 1277 provide larger bearing surfaces to help maintain gage and include longer substrates that are embedded deeper into the gage pad material 1275 for increased retention. The smaller wear resistant elements 1276 are positioned around the larger wear resistant elements 1277 for increased wear resistant coverage.

In the embodiment shown, the larger wear resistant elements 1277 comprise diamond enhanced inserts ("DEIs") which include a layer of polycrystalline diamond material bonded to a substrate. The DEIs are arranged in three rows which generally spanning the length of the gage pad. Five DEIs are disposed in the rows closest to the leading edge and the trailing edge. Four DEIs are positioned in the interior region of the gage pad. The DEIs used on selected bits may have diameters of 13 mm or more to provide larger bearing surface areas of greater than 130 $mm^2$, and may include substrates having lengths of 9 mm or more to allow for good retention during drilling. The substrate end of the DEI is embedded in the matrix material 1275 with the top surface of polycrystalline diamond exposed at the gage pad surface for contact with abrasive slurry and the walls of the wellbore. In other embodiments, DEIs or other large inserts having super abrasive resistant bearing faces of any size may be used in any arrangement desired. In another example, 16 mm or larger DEI inserts are used proximal the leading edge 1270 which act as larger barriers for abrasive slurry passing over the leading edge to help reduce wear of matrix material from around other wear resistant elements on the gage pad behind the leading DEIs. Also, in other embodiments, DEIs may be arranged in three or more rows or with 3 or more DEIs within a one inch length of the gage pad.

The smaller wear resistant elements 1276 comprise thermally stable polycrystalline diamond (TSP) elements embedded in the gage pad material 1275. The gage pad material 1275 comprises a metal carbide matrix material. In selected embodiments, the gage pad material 1275 may also be impregnated with or coated with ultrahard particles, such as diamond grit, to further increase abrasion resistance. In other embodiments, wear resistant elements of any type, number, shape, or size may be used.

For the embodiment shown in FIG. 9, the combination of larger and smaller wear resistant elements 1277, 1276 near leading and trailing edges of the gage pad provide a total diamond (or similar wear resistant element) coverage along each edge that is greater than 75% of the length of the gage pad and closer to 100%. Additionally, close to 50% or more of the gage pad surface comprises diamond. Using larger super abrasive resistant elements with longer substrates near the leading edge of the gage pad reduces wear of matrix material from the gage pad surface such that smaller elements disposed on the gage pads are retained longer during drilling. This will also reduce the amount of material lost from the gage pad during drilling, which will reduce the amount of time and energy required to rebuild the bit.

Figure 10A:
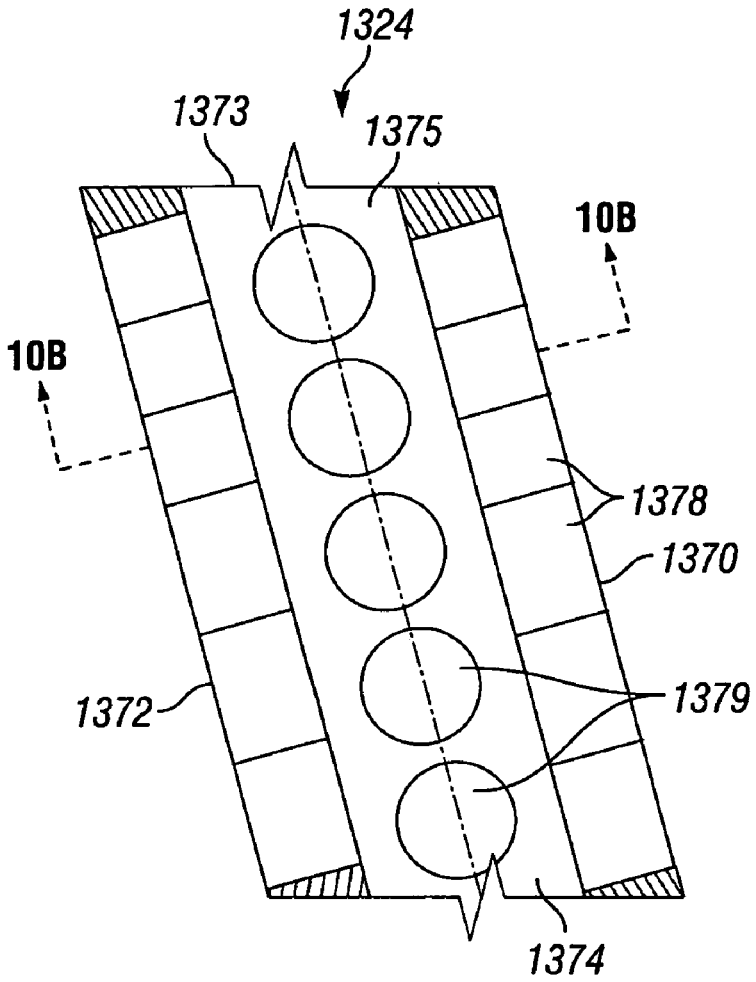
FIGS. 10A-10B another embodiment of a novel abrasive resistant gage pad configuration which may be used on a PDC bit in accordance with one or more embodiments of the present invention.
Figure 10B:
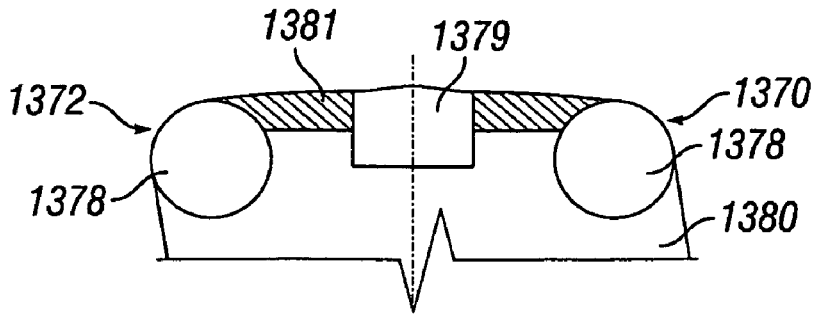

Another example of a novel gage pad layout that may be used for embodiments of the inventions to permit longer drilling runs in abrasive applications is shown in FIGS. 10A and 10B. This gage pad arrangement may also be used for on any bit for enhanced gage protection. In this layout, wear resistant elements are positioned to provide a rounded edge (or surface proximal the edge) on the gage pad which is more resistant to sharp sands in abrasive slurry than the gage pad matrix material.

Referring to FIG. 10A, in accordance with this layout, the gage pad 1324 of the bit is formed of matrix material 1375, such as tungsten carbide infiltrated with binder material. Wear resistant elements 1378 having rounded or convex surfaces are embedded in the matrix material 1375 proximal the leading edge 1370 of the gage pad 1324 such that they are or may eventually become exposed at the leading edge 1370 during drilling to provide a rounded and super abrasive resistant edge on the gage pad 1324. Wear resistant elements 1378 having rounded or convex surfaces are also embedded in the matrix material 1375 proximal the trailing edge 1372 of the gage pad 1324 such that they are or may eventually become exposed at a trailing edge 1372 during drilling to provide a rounded and super abrasive resistant trailing edge for the gage pad 1324.

In the example shown, the wear resistant elements 1378 positioned proximal each edge of the gage pad 1324 are axially aligned and generally arranged end to end along each edge to provide rounded, substantially continuous, and wear resistant edge portions for the gage pad 1324. Small spacing may be provided between the ends of adjacent wear resistant elements 1378 with matrix material disposed there between for enhanced retention of the elements 1378 embedded in the matrix material.

A cross section of the gage pad in FIG. 10A, taken along line A-A, is shown in FIG. 10B. As shown in FIG. 10B, the wear resistant elements 1378 positioned proximal the leading edge 1370 and the trailing edge 1372 of the gage pad 1324 may be cylindrical in form with axes generally parallel to the leading or trailing edge. The wear resistant elements 1378 are at least partially embedded in matrix material 1380 forming the gage pad 1324. When exposed near a leading or trailing edge 1370, 1372 of the gage pad 1324, the wear resistant elements 1378 provide a rounded and super abrasive resistant edge surface which results in a smother flow of abrasive slurry around the edges of the gage pad and significantly reduces wear of material from interior gage pad surfaces. This arrangement also provides a gage pad that is able to retain both edge and interior wear resistant elements 1378, 1379 longer during drilling.

Wear resistant elements 1379 disposed along in the interior region of the gage pad 1324, between the leading edge 1370 and trailing edge 1372, are arranged along the gage pad 1324 to provide super abrasive bearing surfaces for maintaining gage during drilling. In this example, interior wear resistant elements 1379 are generally cylindrical in form with their linear axes generally perpendicular to the outer surface of the gage pad. As shown in FIG. 10B, these interior elements 1379 are embedded in matrix material 1375 forming the gage pad 1324 and have a flat or generally convex end surface exposed along the surface of the gage pad for bearing engagement with wide walls of a wellbore during drilling. In this embodiment, the wear resistant elements 1379 are generally arranged in a row along the length of the gage pad 1324. The gage pad 1324 is also slanted or spiraled such that it has helix angle with respect to the bit axis (not shown). Spiraling the gage pad 1324 provides increased surface area for the gage pad (for a given gage width). Aligning the row of wear resistant elements 1324 generally parallel to the leading edge of the gage pad allows for the placement of more wear resistant elements along the gage pad length, which can result in enhance gage pad protection and drilling life for the bit. However, in other embodiments, any shape or type of gage pad may be used and may include any type, number, size, shape, or arrangement of wear resistant elements to help maintain gage.

In one example, the wear resistant elements 1378 disposed along the leading edge 1370 and trailing edge 1372 of a gage pad are diamond grit hot-pressed inserts (GHIs), which may be infiltrated or brazed into gage pads of a bit, such as the one shown in FIG. 3. GHIs are diamond impregnated elements which can be manufactured by placing a mixture of diamond particles and powdered matrix material in a mold. The contents of the mold are then hot-pressed or sintered at an appropriate temperature, such as between about 1000 and 2200° F., to form a composite diamond-impregnated insert. The diamond particles used may be natural or synthetic and may be obtained in a variety of shapes and grades. In the example, six GHIs are disposed proximal the leading and trailing edges of the gage pad and provide substantially 100% super abrasive coverage along most of the length of the leading and trailing edges. The GHIs may have diameters of up to 13 mm or more and may also have lengths of up to 13 mm or more. In other embodiments, wear resistant elements 1378 positioned to form at least part of the leading edge 1370 or at least part of the at the trailing edge 1372 during drilling may comprise any size, shape or type of super abrasive resistant elements known in the art, including GHIs, PCD elements, TSP elements, polycrystalline cubic boron nitride (PCBN) elements, or the like or combinations thereof.

In the example noted, the interior wear resistant elements 1379 positioned along the interior surface of the gage pad 1324 comprise DEIs with carbide substrates. The carbide substrates are embedded into the gage material with the diamond tables exposed at the surface of the gage pad. The DEIs have diameters of up to 13 mm or more with lengths, including substrates, of up to 9 mm or more. In some cases, DEIs having diameters of 16 mm or more and/or substrates of 13 mm or more are used. In other embodiments, wear resistant elements of any type, number, shape, size, or combination may be used in interior regions of the gage pad, including DEIs, PCD elements, TSP elements, PCBN elements, GHIs, or the like or combinations thereof.

Additionally, the gage pad material 1375 may comprise a harder matrix material than that used to form another part of the bit body as described in relation to other aspect of the invention above. Alternatively or additionally matrix material forming part or the entire outer surface of the gage pad may be impregnated (or coated) with ultrahard particles, such as diamond grit, to provide increased abrasion resistance for the gage pad. For example, as shown for the gage pad layout in FIG. 10B, the outer surface of the gage pad may include a layer of matrix material impregnated with diamond grit 1381 formed on other matrix material 1380 forming part of the gage pad. This may be achieved by packing surfaces in a bit mold which form the gage pad with impregnated material before filing the mold with other matrix material used to form the bit.

In one example, diamond grit having a grain size of around 700 μm or more (150 spc or less) was used to form diamond impregnated surfaces of a gage pad having a similar layout to the one shown in FIGS. 10A and 10B, with 13 mm GHIs used proximal the leading and trailing edges of the gage pad and 13 mm DEIs used along the interior gage pad surface. In another example, diamond grit having a size of around 850 μm more (100 spc or less) was used. In one or more embodiments, the combination of larger wear resistant elements and diamond impregnated matrix material can be used to provide substantially 100% abrasive resistant coverage on the gage pad surface to minimize exposure of underlying matrix material to eroding slurry in ultra abrasive applications. This gage pad combination was used on the bit shown in FIG. 7B and was found to be particularly effective when performing longer drilling runs and/or multiple drilling runs in unconsolidated ultra abrasive formations.

Additionally, the gage pads of the bit may be configured as replaceable gage pads as is generally know in the art with the gage pad layouts designed in accordance with examples given above. In the case of replaceable gage pads, the gage pads and corresponding bit surface may include complementary securing elements which mutually engage one another and the gage pad removably secured to the bit body by brazing, mechanical locking, or the like. Removable gage pads may be used to facility faster rebuild operations.

In general, it has been found that having rounded wear resistant elements positioned proximal the leading edge of a gage pad can significantly reduce wear on gage pad surfaces and increase bit life, especially in ultra abrasive applications. This can also reduce the time and materials required to repair a bit. Also, using GHIs or similar elements may permit the use of larger wear resistant elements along edges of the gage pad and may also result in increased element retention. Using DEIs with longer substrates permits deeper grip in the gage pad material for increased retention. Additionally, the use of matrix material impregnated with ultrahard particles along the outer surface of the gage pad can help to further reduce wear on the gage pads and increase bit life, especially for bits used in ultra abrasive environments.

Back Reaming Features

Figure 11:
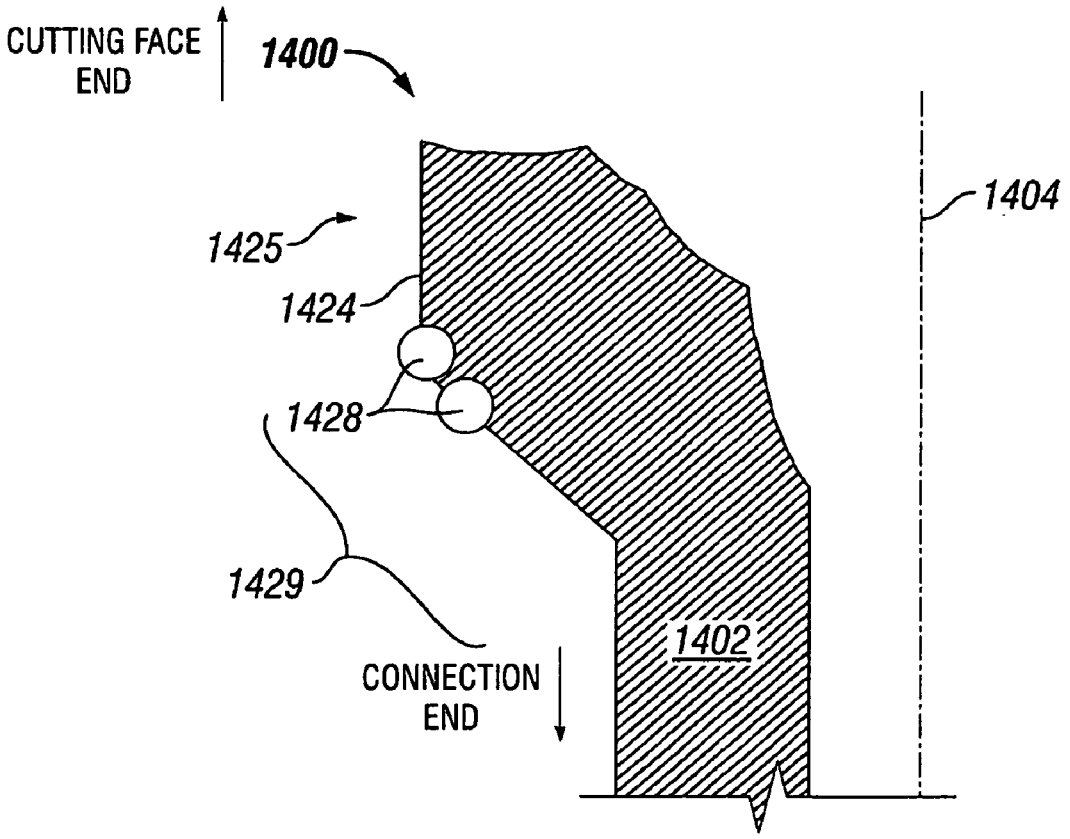
FIG. 11 shows a partial view of a heel surface of a bit with back reaming elements positioned on the bit in accordance with an embodiment of the present invention.
Figure 12A:
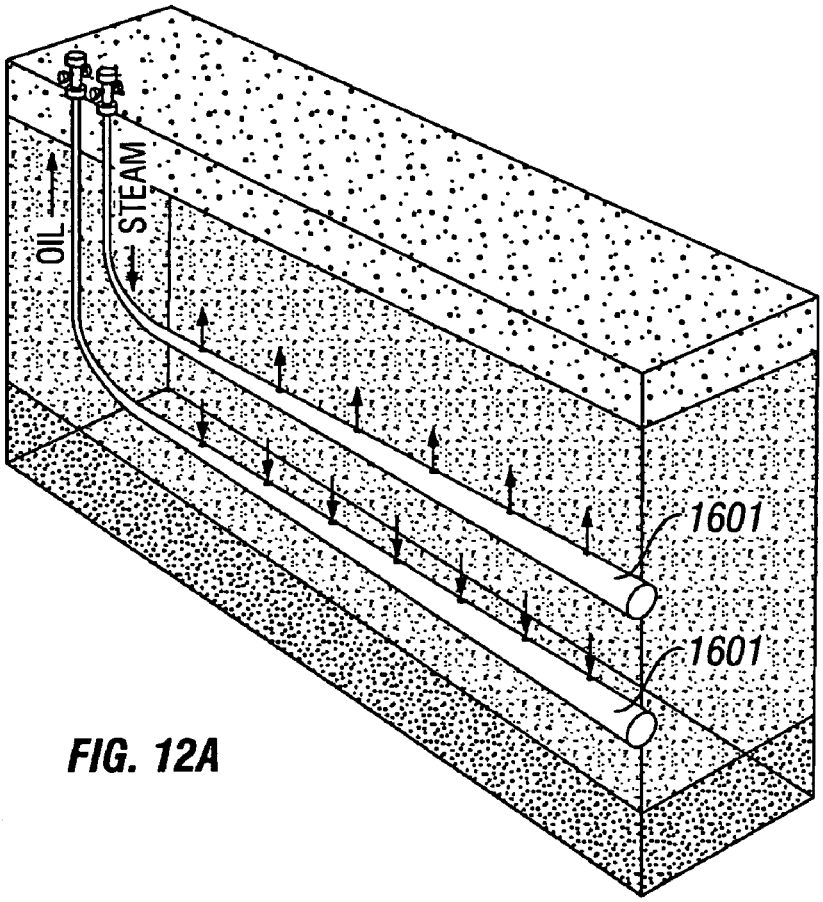
FIG. 12 shows one example of a multi-well system used for Steam Assisted Gravity Drainage recovery of heavy oil from a reservoir.
Figure 12B:
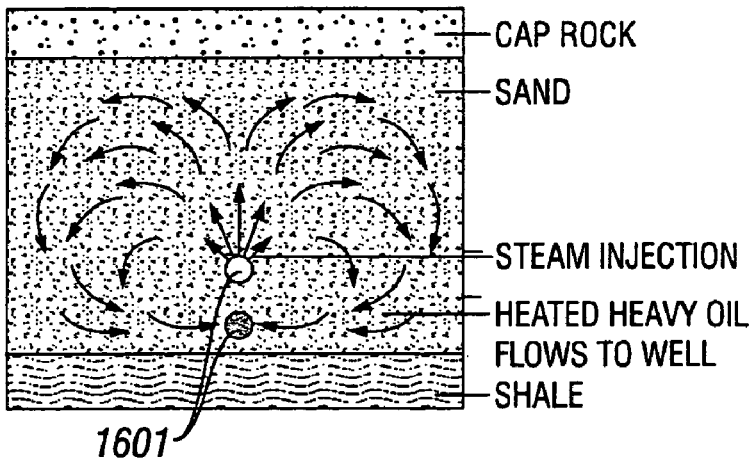

Referring to FIG. 11, one or more embodiments additionally includes at least one back reaming element 1428 positioned on the bit to "back ream" or remove formation in the path of the bit as the bit is pulled from a borehole. The back reaming element 1428 may comprises a PCD cutter or similar shearing element that is preferably positioned to minimize contact with formation during drilling yet positioned to effectively drill through formation in the path of the bit as the bit is pulled out of the wellbore. For example, referring to FIG. 3, back reaming elements (not shown) may be positioned along heel surfaces 229 blades at the side 225 of the bit that support gage pads 224.

FIG. 11 shows an enlarged partial cross section view of a heel surface 1429 of a bit 1400 in accordance with an embodiment of the present invention. The bit 1400 generally comprising a bit body 1402 having a central axis 1404, a connection formed at one end (generally indicated), and a cutting face disposed at another end (general indicated). The bit 1400 also includes one or more gage pads 1424 disposed about a side surface 1425 of the bit 1400. Back reaming elements 1428 are generally positioned along a heel surface 1429 of the blades supporting the gage pad 1424.

Back reaming capability is particularly desired for embodiments of the invention designed for horizontal drilling because cuttings tend to fall to the low side of the hole during drilling such that when the bit is retrieved from the borehole it typically has to plow through cuttings built up on the low side of the hole so that the bit can be removed. Because back reaming elements may have to do a lot of work in these applications, larger back reaming elements and/or a plurality of back reaming elements may be used to provide increased cutting capability and abrasion resistance along heel surfaces of the bit.

In selected embodiments one or more back reaming elements 1428 positioned on a heel surface 1429 of the bit may comprise a larger element, such as PDC cutters (or similar elements) having a diameter of about 13 mm, or more. Alternatively, in one or more other embodiments, at least two back reaming elements 1428 are disposed along selected heel surface of the bit to provide efficient removal capability for the bit when pulled out of the hole. The number and/or size of the back reaming elements on each heel surface may be selected to provide a particular amount of diamond coverage. For example, two or more 16 mm back reaming cutters or cutters of any size may be positioned along heel surfaces of each gage pad blade to provide diamond coverage of greater than 300 $mm^2$ along each of the heel surfaces. Providing good back reaming capability on selected embodiments used for directional drilling eliminates issues of the bit getting stuck in the hole and excessive wear on the heel surfaces of the bit that must be addressed in rebuild operations.

In other embodiments, a back reaming element may comprise any type of active cutting structure known in the art including a PCD compact, a PCBN compact, a diamond impregnated insert, and natural diamond elements. PDC back reaming elements have been found to be particularly effective in maintain gage all the way in horizontal, unconsolidated, ultra abrasive applications. PDC elements having longer substrate lengths also permit deeper penetration of the substrate into the blade matrix material for greater retention of the cutter.

In alternative embodiments, back reaming elements positioned on the bit may comprise different types of cutting elements, such as TSPs and GHIs or PCD compacts. Additionally, cutter types may be arranged to alternate along heel surfaces as desired. Heel surfaces of the bit may also be coated with hardfacing material or impregnated with wear resistant material, such as diamond particles or other wear resistant material, to further reduce wear on the heel surfaces that occurs as bits are removed from longer bit runs.

Hydraulic Considerations

In one or more embodiments, to reduce erosive wear, particularly in high flow rate drilling in unconsolidated, ultra abrasive applications fluid passageway may disposed between the blades may be oriented to direct more of the drilling fluid toward a corresponding junk slot of the bit rather than directly on the cutters. The bit 200 shown in FIG. 2 includes fluid passageways 218 which are generally disposed between each of the blades 208 to wash cuttings from the cutters 210, blades 208 and bottomhole of a wellbore. Fluid passageways 218 are generally oriented at skew angle selected to direct drilling fluid and cuttings substantially parallel to or somewhat away from blade front surfaces to reduce the impingement and velocity of abrasive slurry flowing over the blades 208 and cutters 210. Fluid passageways 218 are also generally oriented with a profile angle that more directs abrasive slurry up the junk slots 226 of the bit rather than for impingement on the bottomhole to help reduce recirculation of abrasive slurry around the bit 200 during drilling. This can also help to prevent over the washing sands and the like from the bottomhole during drilling.

Other design considerations may also be used to reduce the velocity or impingement of the abrasive slurry on the bit body. For example, in one or more embodiments, one more diffuser nozzles may be used to reduce fluid velocities around the cutters to help reduce erosive wear on the cutting structure during drilling. Alternatively, in one or more embodiments, a bit may be designed to include more nozzles 220 than blades 208 to help lower the concentration of hydraulic energy across the cutting face of the bit. Alternatively, a bit may be designed with an increased total flow area, such as by configuring the one or more of the passageways 218 or nozzles 220 to have a larger than normal exit port.

Braze Material

Braze material is typically selected for highest braze strength; however, braze strength is not considered a limiting factor in many unconsolidated, ultra abrasive applications. Therefore, in one or more embodiments, a more viscous braze material may be applied between the cutters and the cutter pockets to increase the reusability of cutters and reduce the cost associated with rebuilding the bit. A more viscous braze material may be used so that when a cutter substrate is slightly eroded or has minor nicks on the exposed portion of the substrate, the cutter can be spun during the rebuild operation to coat the substrate with the thicker braze material to fill the small voids or wear marks and provide sufficient adhesion for subsequent runs.

Therefore, in selected embodiments, a braze material which is or can be kept more viscous during the brazing process may be used to bond one or more of the cutters into the cutter pockets on the blades, especially in locations where erosion of the brazed joint or carbide cutter substrate has been observed or predicted. The more viscous braze material can be selected from alloys having a larger difference between the liquidus (L) and solidus (S) temperatures. For example, the commercial braze alloy BAg7 (L=652° C., S=618° C.), may be selectively replaced with BAg18 (L=718 C, S=602 C) or other silver-based alloys. The alloys may include combinations of small percentages of metallic or transitional elements, or of non-melting elements or refractory particles, which may increase the effective viscosity while brazing. The brazing process can also be controlled to use lower temperatures, which also increases effective viscosity. For example, a braze materials having a larger difference between the liquidus and solidus temperatures can be used to braze cutters at a temperature between the liquidus and solidus temperature, such as around midway between the range, so that the braze material remains more viscous during the brazing process.

Also, in one or more embodiments, a hardfacing overlay coating may be applied to portions of the bit, such as exposed surfaces of braze material to minimize erosion of braze material around the cutters during drilling, as discussed for example in U.S. Pat. No. 6,772,849 to Oldham et al., titled "Protective overlay coating for PDC drill bits" discloses a method of increasing a durability of a PDC drill bit by overlaying at least a portion of the exposed surface of the braze material between the cutter and the cutter pocket with a hardfacing material.

Other Embodiments

Those skilled in the art will appreciate that selected features described above may be combined in various ways as desired for a give application to provide a PDC drill bit capable of drilling longer wellbore segments through abrasive or ultra abrasive formations. It will also be appreciated that in the case of PDC elements or cutters provided on the cutting face of the bit as referenced above, all or a portion of the diamond layer may be leached or otherwise treated to provide increased abrasion resistance.

Bits in accordance with one or more embodiments of the present invention can be used to drill an entire horizontal segment through the pay zone of a heavy oil reservoir, which may extend 1500 meters or more in length. Selected embodiments may provide a drill bit capable of drilling multiple horizontal segments before having to be pulled to the surface and rebuilt. For example, a drill bit may be used to drill a first horizontal leg through a heavy oil reservoir and then side tracked to drill another horizontal leg without having to be pulled back to surface. A drill bit able to drill multiple lateral wells can provide a substantial time and cont savings to a drilling operation. A PDC bit may also include larger cutters such as 16 mm cutters or larger to provide higher ROP as well as durability in drilling heavy oil reservoirs.

In one or more embodiments, erosion between cutters may be reduced by reducing cutter separation distances along surfaces of the bit. In one or more embodiments back reaming capability may be improved by placing larger cutters or a larger number of cutters along heel surfaces of the bit to minimize blade upside wear. Additionally, in one or more embodiments a PDC drill bit may include larger beveled cutters oriented at a back rake for enhanced steerability and/or to help minimize impact damage that can result from drilling out equipment in the wellbore or contacting harder formation stringers that dip into a drilling zone.

In accordance with one or more embodiments erosion on cutter substrates may be reduced by limiting the amount of substrate material exposed to the formation, by placing cutters at higher back rake, and/or by minimizing spacing between cutters. In one or more embodiments, erosion may be reduced around the cutters by placing PDC cutters substantially flush with the blade face and by providing cutter arrangements that do not include additional gaps or spaces, such as cutter pocket relief grooves. Erosion and abrasion may also be reduced by directing fluid nozzles towards the center of fluid channels or slightly away from the corresponding blade front face. Also, in one or more embodiments blades having limited helix may be used and/or and with diamond imbedded in the blade tops and/or cutter substrates to reduce wear behind the cutters and across the blade tops.

Additionally, a novel gage pad configuration may be used on any bit to minimize gage pad wear. Additionally, using gage pads with larger surface area, such as wider or more spiral gage pads, may help maximize diamond coverage on the gage of the bit. In one or more embodiments, the diamond coverage on a gage pad may be 35% or more, and in some cases 50% or more. In one embodiment a gage pad may comprise five or more gage pad elements with diameters of 13 mm or more arranged in a row along the gage pad. In another embodiment, a gage pad may comprise seven or more gage pad elements having diameters of 13 mm or more. In one or more embodiments, larger wear resistant elements, such as GHIs, DEIs or ultrahard compacts, may be placed closer to the leading and/or trailing edges of the gage pads to reduce gage pad wear. Wear resistant elements having rounded surfaces may be disposed proximal the leading edge of the gage pad to provide a rounded edge resistant to sharp sands in the abrasive slurry to help maintain the leading edge longer. Wear resistant elements disposed in the gage pad may be infiltrated or brazed into the gage pad. In one or more embodiments, impregnated diamond grit may be used to form surfaces of the bit, such as part of the gage pad and/or blade tops to provide increased abrasion resistant for extended bit life.

In other embodiments, a coating may also be applied to surfaces of the bit to provide increased abrasion resistance. For example, CVD technology or other coating technology may be applied to coat leading edges or surfaces of the gage pad. PDC bits having enhanced gage features in accordance with one or more embodiments of the present invention may be able to effectively resist going under gage during extended drilling runs, which minimizes the risk of compromising the effective diameter of the wellbore and subsequent operational complications.

One or more embodiments, a PDC bit having cutters closely spaced, limited blade helix, natural diamond embedded in blade tops, rounded wear elements disposed along leading and trailing edges of the gage pad, and impregnated diamond in the gage pad may be used to provide an economic benefit to a high ROP, heavy oil drilling program.

PDC bits including selected features described above may be rebuilt and reusable a sufficient number of times to provide a positive economic impact to an overall drilling program in unconsolidated, ultra abrasive formations and similar formations. Such bits may also make it possible to drill longer horizontal segments in these environments without having to pull a bit to the surface.

While the invention has been described with respect to a limited number of embodiments, those skilled in the art will appreciate that numerous other embodiments can be devised which do not depart from the scope of the invention as set forth in the appended claims.

The invention claimed is:

1. A fixed cutter drill bit for drilling through unconsolidated, highly abrasive formations, the drill bit comprising:

a bit body having a longitudinal axis, a cutting face, and a side portion, the bit body comprising carbide matrix material;

a plurality of blades azimuthally spaced about the cutting face;

a plurality of cutters disposed along the blades; and at least one gage pad disposed along a side of the bit body, the at least one gage pad comprising a plurality of wear resistant elements at least partially embedded in the gage pad, wherein each of the plurality of wear resistant elements includes a rounded surface and is formed of a material more wear resistant than matrix material forming a portion of the gage pad;

wherein the at least one gage pad has a substantially continuous leading edge extending the length of the gage pad; and wherein the rounded surfaces of the plurality of wear resistant elements are aligned to form a substantially continuously rounded wear-resistant leading edge on the gage pad.

2. The drill bit of claim 1, wherein the matrix material comprises tungsten carbide powder having an average grain size of about 60 μm or less formed with a metallic binder.

3. The drill bit of claim 1, wherein the matrix material comprises a matrix power including at least about 40% by weight tungsten carbide having an average particle size of between about 0.2 and 30 μm formed with a metallic binder.

4. The drill bit of claim 1, wherein the matrix material comprises cast carbide in an amount of at least about 40% or more by weight.

5. The drill bit of claim 1, wherein the bit body, at least one of the blades, or the at least one gage pad comprises a coating of ultrahard material or ultrahard material embedded in a surface thereof.

6. The drill bit of claim 5, wherein the at least one of the blades or the at least one gage pad comprises ultrahard material embedded therein.

7. The drill bit of claim 6, wherein the ultrahard material comprises diamond grit impregnated in the gage pad surface.

8. The drill bit of claim 7, wherein substantially the entire gage pad surface around the wear resistant elements is impregnated with diamond grit.

9. The drill bit of claim 5, wherein the at least one blade comprises a plurality of blades having surface set diamonds embedded in blade tops.

10. The drill bit of claim 5, wherein the ultrahard material has a grain size of at least about 700 μm or more.

11. The drill bit of claim 1, wherein the bit body, the blades, or the at least one gage pad is formed of a first matrix material and a second matrix material wherein the first matrix material has a different wear resistance than the second matrix material.

12. The drill bit of claim 1, wherein at least one of the blades increases in thickness in a direction away from the center of the bit body, and is configured to have a wider blade base than blade top along a portion thereof.

13. The drill bit of claim 12, wherein at least one of the blades has a blade front face angle or a blade back face angle greater than about 5°.

14. The drill bit of claim 12, wherein at least one blade has a blade front radius of curvature or a blade back face radius of curvature of least about 0.375 inches.

15. The drill bit of claim 1, wherein a majority of the cutters have a back rake angle of at least about 20°.

16. The drill bit of claim 15, wherein selected ones of said cutters have a back rake angle of at least about 30°.

17. The drill bit of claim 1, where the cutters along a majority of the blades increase in back rake angle along a profile of the bit toward gage.

18. The drill bit of claim 1, wherein selected ones of the cutters have a side rake angle greater than 0°.

19. The drill bit of claim 1, wherein the cutters on the bit are arranged in a short parabolic cutting profile.

20. The drill bit of claim 1, wherein the cutters are positioned to minimize an imbalance force on the bit or a difference in work rate between cutters on the bit.

21. The drill bit of claim 1, wherein cutters along at least one of the blades are arranged to form a helix angle of less than 5°.

22. The drill bit of claim 21, wherein the cutters along the at least one of the blades are arranged to form a helix angle of 2° or less.

23. The drill bit of claim 1, wherein at least one of the cutters comprises a bevel about a periphery of its cutting face, wherein the bevel has width of at least about 0.012 inches and is at an angle of around 45° from a side surface of the cutter.

24. The drill bit of claim 1, wherein a majority of adjacent cutters along the blades are spaced about 0.04 inches or less apart.

25. The drill bit of claim 1, wherein a majority of the cutters positioned on the blades have an exposed substrate length of around 13 mm or less.

26. The drill bit of claim 25, wherein selected ones of the cutters have an exposed substrate length of about 9 mm or less.

27. The drill bit of claim 1, wherein a majority of the cutters have a diameter of at least about 16 mm.

28. The drill bit of claim 27, wherein at least some of the cutters have a diameter of at least about 19 mm.

29. The drill bit of claim 1, wherein a cutter extent from a corresponding blade front face is less than or equal to about 0.06 inches.

30. The drill bit of claim 29, wherein a majority of the cutters are arranged substantially flush with corresponding blade front faces.

31. The drill bit of claim 1, wherein the bit comprises less than 8 blades.

32. The drill bit of claim 31, wherein the bit comprises 6 blades or less.

33. The drill bit of claim 1, wherein at least one of the cutters comprise a table of ultrahard material integrally formed with a carbide substrate comprising tungsten carbide particles formed with a metallic binder, and the substrate comprises one selected from the group of a binder content of 12% by weight or less, a hardness of at least about 90 Ra, and a tungsten carbide content of at least about 88% by weight.

34. The drill bit of claim 33, wherein the substrate has an average carbide particle size of about 3 microns or less.

35. The drill bit of claim 33, wherein the substrate further comprises ultrahard particles embedded therein.

36. The drill bit of claim 35, wherein the substrate further comprises an ultrahard element band embedded therein and generally positioned behind the table of ultrahard material forming a cutting face.

37. The drill bit of claim 33, wherein a coating is disposed on at least a portion of the substrate and the coating comprises ultrahard material.

38. The drill bit of claim 33, wherein the table of ultrahard material comprises polycrystalline diamond bonded to the substrate and the polycrystalline diamond is partially or entirely thermally stable.

39. The drill bit of claim 1, wherein the at least one gage pad having a circumferential width of at least about 2 inches or comprising a plurality of gage pads arranged about the bit body to provide a total gage pad peripheral coverage of greater than or equal 30% of the circumference of the bit.

40. The drill bit of claim 1, wherein the at least one gage pad extends a length of at least about 2 inches along the side of the bit body.

41. The drill bit of claim 40, wherein the at least one gage pad extends a length of at least about 4 inches along a side of the bit body.

42. The drill bit according to claim 1, wherein at least one back-reaming element is positioned along a heel surface of the bit to back-ream formation in a path of the bit when the bit is pulled from a wellbore.

43. The drill bit according to claim 1, wherein a second plurality of wear-resistant elements comprising rounded surfaces are embedded in the surface of the gage pad proximal a trailing edge of the gage pad to provide rounded wear resistant protection proximal the trailing edge.

44. The drill bit of claim 43, wherein the wear resistant elements proximal the leading edge of the gage pad are generally cylindrical in form and aligned substantially end to end along the leading edge to provide a rounded wear resistant edge along the leading edge of the gage pad.

45. The drill bit of claim 44, wherein the wear resistant elements proximal the trailing edge of the gage pad are also generally cylindrical in form and aligned substantially end to end along the trailing edge to provide a rounded wear resistant edge surface along the trailing edge of the gage pad.

46. The drill bit of claim 43, wherein the wear resistant elements proximal the trailing edge of the gage pad are positioned to generally cover at least 75% of the gage pad length along the trailing edge.

47. The drill bit of claim 43, wherein a third plurality of wear resistant elements are arranged in an interior region of the gage pad between the leading edge and the trailing edge, wherein at least one of the third plurality of wear resistant elements is disposed proximal a bottom edge of the gage pad and at least one of the third plurality of wear resistant elements is disposed proximal a top edge of the gage pad.

48. The drill bit of claim 47, wherein the wear resistant elements comprise elements selected from the group of thermally stable polycrystalline diamond elements, polycrystalline diamond elements, and grit hot-pressed inserts.

49. The drill bit of claim 43, wherein a plurality of interiorly positioned wear resistant elements along a surface of the gage pad between the leading and trailing edges and comprise diamond enhanced inserts or TSP elements having diameters of at least about 13 mm.

50. The drill bit of claim 49, wherein at least one of the diamond enhanced inserts or TSP elements has a diameter of at least about 16 mm.

51. The drill bit of claim 50, wherein a plurality of the diamond enhanced inserts or TSP elements have a diameter of at least about 16 mm.

52. The drill bit of claim 49, wherein the diamond enhanced inserts have substrate lengths of at least about 13 mm and at least a portion of the substrate is embedded in the gage pad.

53. The drill bit of claim 50, wherein the plurality of diamond enhanced inserts or TSP elements comprises at least 5.

54. The drill bit of claim 49, wherein wear resistant elements cover at least about 50% of the outer surface of the gage pad.

55. The drill bit of claim 43, wherein the wear resistant elements disposed proximal the leading edge or the trailing edge comprise a plurality of diamond enhanced inserts having a diameter of at least about 13 mm.

56. The drill bit of claim 1, wherein the at least one gage pad is slanted at an angle with respect to the longitudinal axis of the bit such that at least one of the leading or a trailing edges of the gage pad is oriented at an angle of at least about 10° with respect to the longitudinal axis of the bit.

57. The drill bit of claim 1, wherein the drill bit comprises a plurality of heel surfaces each having at least one back reaming element disposed along the heel surface.

58. The drill bit of claim 57, wherein a plurality of back reaming elements is disposed along each of the heel surfaces.

59. The drill bit of claim 57, wherein the back reaming elements comprise PDC cutters having a diameter of at least about 13 mm.

60. The drill bit of claim 59, wherein the cutters comprise polycrystalline diamond having a thermally stabilized surface layer.

61. The drill bit of claim 60, wherein the PDC cutters comprises a substrate having a length of at least about 13 mm.

62. The drill bit of claim 1, further comprising fluid ports disposed in the bit body and oriented to direct fluid towards a center of a corresponding fluid channel or away from a corresponding blade front face.

63. The drill bit of claim 1, wherein a coating of ultrahard material is applied to a portion of the bit body by chemical vapor deposition.

64. The drill bit of claim 1, wherein a surface of the bit comprises a diamond coating.

65. The drill bit of claim 1, further comprising a plurality of fluid ports generally disposed between the blades wherein a number of fluid ports is greater than the number of blades.

66. The drill bit of claim 1, wherein the drill bit further comprises a fluid port and the fluid port comprises a diffuser nozzle.

67. A method for drilling unconsolidated, ultra abrasive formations, comprising:

providing a fixed cutter drill bit according to claim 1; and rotating the drill bit to form a wellbore.

68. A method of manufacturing a drill bit for high rate of penetration unconsolidated abrasive drilling environments, the method comprising:

forming a bit body having a longitudinal axis, a cutting face, and a side portion, the bit body comprising carbide matrix material;

forming a plurality of blades azimuthally spaced about the cutting face;

disposing at least one gage pad along a side of the bit body;

disposing a plurality of cutters on at least one of the plurality of blades; and embedding a first plurality of wear resistant elements in the at least one gage pad, wherein each of the plurality of wear resistant elements are at least partially embedded in the at least one gage pad, each of the first plurality of wear resistant elements have a longitudinal axis, an upper end, a lower end, and a rounded side surface, each of the first plurality of wear resistant elements are formed of a material more wear resistant than the gage pad, the at least one gage pad has a leading edge extending along at least a portion of the length of the gage pad, and the first plurality of wear resistant elements are positioned along at least a portion of the leading edge of the at least one gage pad and are axially aligned along their longitudinal axes forming a rounded, substantially continuous and wear-resistant portion of the leading edge of the gage pad.

69. A fixed cutter drill bit for drilling through unconsolidated, highly abrasive formations, the drill bit comprising:

a bit body having a longitudinal axis, a cutting face, and a side portion, the bit body comprising carbide matrix material;

a plurality of blades azimuthally spaced about the cutting face;

a plurality of cutters disposed along the blades; and at least one gage pad disposed along a side of the bit body comprising a matrix material, the at least one gage pad further comprising a first plurality of wear resistant elements at least partially embedded in the gage pad, wherein each of the first plurality of wear resistant elements have a longitudinal axis, an upper end, a lower end, and a rounded side surface, and wherein each of the first plurality of wear resistant elements are formed of a material more wear resistant than the matrix material forming a portion of the gage pad;

wherein the at least one gage pad has a leading edge extending along at least a portion of the length of the gage pad; and wherein the first plurality of wear resistant elements are positioned along at least a portion of the leading edge of the at least one gage pad and are axially aligned along their longitudinal axes forming a rounded, substantially continuous and wear-resistant portion of the leading edge of the gage pad.

70. The drill bit of claim 69, wherein a second plurality of wear-resistant elements are embedded in the surface of the gage pad, each of the second plurality of wear resistant elements are formed of a material more wear resistant than the matrix material forming a portion of the gage pad and have a longitudinal axis, an upper end, a lower end, and a rounded side surface, the second plurality of wear resistant elements are positioned along at least a portion of a trailing edge of the at least one gage pad and are axially aligned along their longitudinal axes providing a rounded, substantially continuous and wear-resistant portion of the trailing edge of the gage pad.

71. The drill bit of claim 70, wherein the second plurality of wear resistant elements are substantially cylindrical in form.

72. The drill bit of claim 69, wherein the first plurality of wear resistant elements are substantially cylindrical in form.

73. The drill bit of claim 69, wherein the leading edge extends the length of the at least one gage pad and the first plurality of wear resistant elements are positioned to generally cover at least 75% of the leading edge of the gage pad.

74. The drill bit of claim 69, wherein the first plurality of wear resistant elements are positioned to substantially span the length of the leading edge of the at least one gage pad.

75. The drill bit of claim 74, wherein the first, second, and third plurality of wear resistant elements have diameters of at least about 13 mm.

76. The drill bit of claim 69, wherein a third plurality of wear resistant elements are embedded in an interior region of the gage pad between the leading edge and a trailing edge of the at least one gage pad, wherein at least one of the third plurality of wear resistant elements is disposed proximal a bottom edge of the gage pad and at least one of the third plurality of wear resistant elements is disposed proximal a top edge of the gage pad.

77. The drill bit of claim 76, wherein each of the third plurality of wear resistant elements have a longitudinal axis and are positioned such that the longitudinal axis is substantially perpendicular to the adjacent surface of the at least one gage pad.

78. The drill bit of claim 69, wherein the first plurality of wear resistant elements are selected from the group consisting of thermally stable polycrystalline diamond elements, polycrystalline diamond elements, grit hot-pressed inserts, and combinations thereof.

79. The drill bit of claim 69, wherein the bit body, at least one of the blades, or the at least one gage pad comprises a coating of ultrahard material or ultrahard material embedded in a surface thereof.

80. The drill bit of claim 69, wherein the bit body, the blades, or the at least one gage pad is formed of a first matrix material and a second matrix material wherein the first matrix material has a different wear resistance than the second matrix material.

81. The drill bit of claim 69, wherein the at least one gage pad is slanted at an angle with respect to the longitudinal axis of the bit such that at least one of the leading or a trailing edge of the gage pad is oriented at an angle of at least about 10° with respect to the longitudinal axis of the bit.

82. A method for drilling unconsolidated, ultra abrasive formations, comprising: providing a fixed cutter drill bit according to claim 69;

rotating the drill bit to form a wellbore.

* * * * *